US009396731B2

(12) United States Patent
Herre et al.

(10) Patent No.: US 9,396,731 B2
(45) Date of Patent: Jul. 19, 2016

(54) SOUND ACQUISITION VIA THE EXTRACTION OF GEOMETRICAL INFORMATION FROM DIRECTION OF ARRIVAL ESTIMATES

(71) Applicant: Fraunhofer-Gesellschaft zur Foerderung der angewandten Forschung e.V., Munich (DE)

(72) Inventors: Juergen Herre, Buckenhof (DE); Fabian Kuech, Erlangen (DE); Markus Kallinger, Luebeck (DE); Giovanni Del Galdo, Martinroda (DE); Oliver Thiergart, Forchheim (DE); Dirk Mahne, Nuremberg (DE); Achim Kuntz, Hemhofen (DE); Michael Kratschmer, Forchheim (DE); Alexandra Craciun, Erlangen (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 168 days.

(21) Appl. No.: 13/904,870

(22) Filed: May 29, 2013

(65) Prior Publication Data

US 2013/0259243 A1 Oct. 3, 2013

Related U.S. Application Data

(63) Continuation of application No. PCT/EP2011/071629, filed on Dec. 2, 2011.

(60) Provisional application No. 61/419,623, filed on Dec. 3, 2010, provisional application No. 61/420,099, filed on Dec. 6, 2010.

(51) Int. Cl.
*H04R 3/00* (2006.01)
*H04R 1/32* (2006.01)
(Continued)

(52) U.S. Cl.
CPC ..... *G10L 19/00* (2013.01); *G10L 19/02* (2013.01); *G10L 19/167* (2013.01); *G10L 19/20* (2013.01);
(Continued)

(58) Field of Classification Search
CPC ..... G10L 19/02; G10L 19/167; G10L 19/00; G10L 19/20; G10L 19/008; H04R 1/326; H04R 3/005; H04R 2430/21
USPC ..... 381/57
See application file for complete search history.

(56) References Cited

U.S. PATENT DOCUMENTS 6,072,878 A 6/2000 Moorer
6,600,824 B1 7/2003 Matsuo
(Continued)

FOREIGN PATENT DOCUMENTS

CN 1452851 A 10/2003
CN 1714600 A 12/2005
(Continued)

OTHER PUBLICATIONS

Schultz-Amling et al., "Virtual acoustic zoom based on parametric spatial audio representations", U.S. Appl. No. 61/287,596, filed Dec. 17, 2009, 11 pages.
(Continued)

*Primary Examiner* — Sonia Gay
(74) *Attorney, Agent, or Firm* — Michael A. Glenn; Perkins Coie LLP

(57) ABSTRACT

An apparatus for generating an audio output signal to simulate a recording of a virtual microphone at a configurable virtual position in an environment includes a sound events position estimator and an information computation module. The former is adapted to estimate a sound source position indicating a position of a sound source in the environment, wherein the sound events position estimator is adapted to estimate the sound source position based on first and second direction information provided by first and second real spatial microphones, respectively, located at first and second real microphone positions in the environment, respectively. The information computation module is adapted to generate the audio output signal based on a first recorded audio input signal, on the first real microphone position, on the virtual position of the virtual microphone, and on the sound source position.

18 Claims, 17 Drawing Sheets

(51) Int. Cl.

| | |
|---|---|
| ***G10L 19/00*** | (2013.01) |
| ***G10L 19/16*** | (2013.01) |
| ***G10L 19/02*** | (2013.01) |
| ***G10L 19/20*** | (2013.01) |
| *G10L 19/008* | (2013.01) |

(52) U.S. Cl.

CPC ..... *H04R 1/326* (2013.01); *H04R 3/005* (2013.01); *G10L 19/008* (2013.01); *H04R 2430/21* (2013.01)

(56) References Cited

U.S. PATENT DOCUMENTS

| | | | | |
|---|---|---|---|---|
| 6,618,485 | B1 * | 9/2003 | Matsuo | 381/92 |
| 6,904,152 | B1 | 6/2005 | Moorer | |
| 7,606,373 | B2 | 10/2009 | Moorer | |
| 8,405,323 | B2 | 3/2013 | Finney et al. | |
| 2002/0001389 | A1 | 1/2002 | Amiri et al. | |
| 2004/0138873 | A1 | 7/2004 | Heo et al. | |
| 2004/0157661 | A1 | 8/2004 | Ueda et al. | |
| 2004/0186734 | A1 | 9/2004 | Heo et al. | |
| 2004/0193430 | A1 | 9/2004 | Heo et al. | |
| 2005/0141728 | A1 | 6/2005 | Moorer | |
| 2005/0281410 | A1 | 12/2005 | Grosvenor et al. | |
| 2006/0002566 | A1 | 1/2006 | Choi et al. | |
| 2006/0010445 | A1 | 1/2006 | Peterson et al. | |
| 2006/0171547 | A1 | 8/2006 | Lokki et al. | |
| 2007/0032894 | A1 | 2/2007 | Uenishi et al. | |
| 2007/0203598 | A1 | 8/2007 | Seo et al. | |
| 2007/0297616 | A1 | 12/2007 | Plogsties et al. | |
| 2008/0298610 | A1 | 12/2008 | Virolainen et al. | |
| 2009/0043591 | A1 | 2/2009 | Breebaart et al. | |
| 2009/0051624 | A1 | 2/2009 | Finney et al. | |
| 2009/0129609 | A1 | 5/2009 | Oh et al. | |
| 2009/0147961 | A1 | 6/2009 | Lee et al. | |
| 2009/0252356 | A1 | 10/2009 | Goodwin et al. | |
| 2010/0169103 | A1 | 7/2010 | Pulkki | |
| 2010/0208904 | A1 | 8/2010 | Nakajima et al. | |
| 2011/0313763 | A1 | 12/2011 | Amada | |
| 2012/0014535 | A1 | 1/2012 | Oouchi et al. | |
| 2012/0140947 | A1 * | 6/2012 | Shin | 381/92 |
| 2013/0016842 | A1 | 1/2013 | Schultz-Amling et al. | |

FOREIGN PATENT DOCUMENTS

| | | | |
|---|---|---|---|
| CN | 101473645 | A | 7/2009 |
| CN | 101485233 | A | 7/2009 |
| EP | 2154910 | A1 | 2/2010 |
| GB | 2414369 | A | 11/2005 |
| JP | H01109996 | A | 4/1989 |
| JP | H04181898 | A | 6/1992 |
| JP | H1063470 | A | 3/1998 |
| JP | 2001045590 | A | 2/2001 |
| JP | 2002051399 | A | 2/2002 |
| JP | 2004193877 | A | 7/2004 |
| JP | 2004242728 | A | 9/2004 |
| JP | 2006503491 | A | 1/2006 |
| JP | 2008028700 | A | 2/2008 |
| JP | 2008197577 | A | 8/2008 |
| JP | 2008245984 | A | 10/2008 |
| JP | 2009089315 | A | 4/2009 |
| JP | 2009216473 | A | 9/2009 |
| JP | 2009246827 | A | 10/2009 |
| JP | 2009537876 | A | 10/2009 |
| JP | 2010147692 | A | 7/2010 |
| JP | 2010525646 | A | 7/2010 |
| JP | 2010193451 | A | 9/2010 |
| JP | 2010232717 | A | 10/2010 |
| RU | 2315371 | C2 | 1/2008 |
| RU | 2383939 | C2 | 3/2010 |
| RU | 2396608 | C2 | 8/2010 |
| TW | 200701823 | | 1/2007 |
| WO | WO-2004077884 | A1 | 9/2004 |
| WO | 2005/098826 | A1 | 10/2005 |
| WO | WO-2006006935 | A1 | 1/2006 |
| WO | 2006/072270 | A1 | 7/2006 |
| WO | 2006/105105 | A2 | 10/2006 |
| WO | Wo-2007025033 | A2 | 3/2007 |
| WO | WO-2008128989 | A1 | 10/2008 |
| WO | 2009/046223 | A2 | 4/2009 |
| WO | 2009/089353 | A1 | 7/2009 |
| WO | 2010/028784 | A1 | 3/2010 |
| WO | WO-2010028784 | A1 | 3/2010 |
| WO | 2010/122455 | A1 | 10/2010 |
| WO | 2010/128136 | A1 | 11/2010 |

OTHER PUBLICATIONS

Chien, Jen-Tzung et al., "Car Speech Enhancement Using Microphone Array Beamforming and Post Filters", Proceedings of the 9th Australian International Conference on Speech Science & Technology; Melbourne, Dec. 2-5, 2002, pp. 568-572.

Del Galdo, G. et al., "Generating Virtual Microphone Signals Using Geometrical Information Gathered by Distributed Arrays", IEEE, 2011 Joint Workshop on Hands-free Speech Communications and Microphone Arrays., May 30-Jun. 1, 2011, pp. 185-190.

Del Galdo et al., "Optimized Parameter Estimation in Directional Audio Coding Using Nested Mircophone Arrays", AES Convention Paper 7911; Presented at the 127th Convention; New York, NY, USA, Oct. 9-12, 2009, 9 pages.

Engdegard, J. et al., "Spatial Audio Object Coding (SAOC)—The Upcoming MPEG Standard on Parametric Object Based Audio Coding", Audio Engineering Society Convention Paper, Presented at the 124th Convention, Amsterdam, The Netherlands, May 17-20, 2008, 15 pages.

Fahy, F.J., "Sound energy and sound intensity", Chapter 4, Essex: Elsevier Science Publishers Ltd., 1989, pp. 38-88.

Faller, C. , "Microphone Front-Ends for Spatial Audio Coders", Audio Engineering Society Convention Paper 7508; Presented at the 125th Convention, San Francisco, CA, USA, Oct. 2-5, 2008, 10 pages.

Faller, C., "Obtaining a Highly Directive Center Channel from Coincident Stereo Microphone Signals", AES Convention Paper 7380; Presented at the 124th Convention; Amsterdam, The Netherlands, May 17-20, 2008, 7 pages.

Furness, R. , "Ambisonics—An Overview", Minim Electronics Limited, Burnham, Slough,U.K.; AES 8th International Conference; Apr. 1990, pp. 181-190.

Gallo, Emmanuel et al., "Extracting and Re-Rendering Structured Auditory Scenes from Field Recordings", AES 30th Int'l Conference; Saariselkä, Finland, Mar. 15-17, 2007, 11 pages.

Gerzon, M., "Ambisonics in Multichannel Broadcasting and Video", Journal Audio Engineering Society, vol. 33, No. 11, Nov. 1985, pp. 859-871.

Herre, J. et al., "Interactive Teleconferencing Combining Spatial Audio Object Coding and DirAC Technology", AES Convention Paper 8098; Presented at the 128th Convention; London, UK, May 22-25, 2010, 12 pages.

Herre, J. et al., "MPEG Surround—The ISO/MPEG Standard for Efficient and Compatible Multi-Channel Audio Coding", Audio Engineering Society Convention Paper, Presented at the 122nd Convention, Vienna, Austria, May 5-8, 2007, 23 pages.

Kallinger, M. et al. "A Spatial Filtering Approach for Directional Audio Coding", AES Convention Paper 7653; Presented at the 126th Convention; Munich, Germany, May 7-10, 2009, 10 pages.

Kallinger, M. et al., "Enhanced Direction Estimation using Microphone Arrays for Directional Audio Coding", in Hands-Free Speech Communication and Microphone Arrays (HSCMA), May 2008, pp. 45-48.

Kuntz, A. et al., "Limitations in the Extrapolation of Wave Fields from Circular Measurements", 15th European Signal Processing Conference (EUSIPCO 2007), Poznan, Poland, Sep. 3-7, 2007, pp. 2331-2335.

Marro, C. et al., "Analysis of Noise Reduction and Dereverberation Techniques Based on Microphone Arrays With Postfiltering", IEEE Transactions on Speech and Audio Processing, vol. 6, No. 3, May 1998, pp. 240-259.

(56) References Cited

OTHER PUBLICATIONS

Pulkki, V., "Directional audio coding in spatial sound reproduction and stereo upmixing", AES 28th International Conference, Piteå, Sweden, Jun. 30-Jul. 2, 2006, pp. 1-8.
Pulkki, V., "Spatial Sound Reproduction with Directional Audio Coding", J. Audio Eng. Soc., Helsinki Univ. of Technology, Finland; 55(6), Jun. 2007, pp. 503-516.
Rickard, S. et al., "On the Approximate W-Disjoint Orthogonality of Speech", In the International Conference on Acoustics, Speech and Signal Processing, Apr. 2002, vol. 1, pp. I-529-I-532.
Roy, R. et al. , "Direction-of-Arrival Estimation by Subspace Rotation Methods—*ESPRIT*", In IEEE International Conference on Acoustics, Speech, and Signal Processing (ICASSP), Stanford, CA, USA, Apr. 1986, pp. 2495-2498.
Roy, R. et al., "ESPRIT—Estimation of Signal Parameters Via Rotational Invariance Techniques", IEEE Transactions on Acoustics, Speech, and Signal Processing, vol. 37, No. 7, Jul. 1989, pp. 984-995.
Schmidt, R. , "Multiple Emitter Location and Signal Parameter Estimation", IEEE Transactions on Antennas and Propagation, vol. 34, No. 3, Mar. 1986, pp. 276-280.
Schultz-Amling, R. et al., "Acoustical Zooming Based on a Parametric Sound Field Representation", AES Convention Paper 8120; Presented at the 128th Convention; London, UK, May 22-25, 2010, 9 pages.
Schultz-Amling, R. et al., "Planar Microphone Array Processing for the Analysis and Reproduction of Spatial Audio using Directional Audio Coding", Audio Engineering Society, Convention Paper 7375, Presented at the 124th Convention, Amsterdam, The Netherlands, May 17-20, 2008, 10 pages.
Simmer, K. U. et al., "Time Delay Compensation for Adaptive Multichannel Speech Enhancement Systems", Proceedings of ISSSE-92, Paris, Sep. 1-4, 1992, 4 pages.
Steele, Michael J. , "Optimal Triangulation of Random Samples in the Plane", The Annals of Probability, vol. 10, No. 3, Aug. 1982, pp. 548-553.
Vilkamo, J. et al., "Directional Audio Coding: Virtual Microphone-Based Synthesis and Subjective Evaluation", J. Audio Eng. Soc., vol. 57, No. 9., Sep. 2009, pp. 709-724.
Walther, A. et al., "Linear Simulation of Spaced Microphone Arrays Using B-Format Recordings", Audio Engineering Society, Convention Paper 7987, Presented at the 128th Convention, May 22-25, 2010, London, UK, 7 pages.
Williams, E.G., "Fourier Acoustics: Sound Radiation and Nearfield Acoustical Holography; Chapter 3, The Inverse Problem: Planar Nearfield Acoustical Holography", Academic Press, Jun. 1999, pp. 89-114.
Karbasi, Amin et al., "A New DOA Estimation Method Using a Circular Microphone Array", School of Comp. and Commun. Sciences, Ecole Polytechnique Federale de Lausanne CH-1015 Lausanne, Switzerland, 2007, 778-782.

* cited by examiner

SOUND ACQUISITION VIA THE EXTRACTION OF GEOMETRICAL INFORMATION FROM DIRECTION OF ARRIVAL ESTIMATES

CROSS-REFERENCE TO RELATED APPLICATIONS

This application is a continuation of copending International Application No. PCT/EP2011/071629, filed Dec. 2, 2011, which claims priority from U.S. Provisional No. 61/419,623, filed Dec. 3, 2010, and U.S. Provisional No. 61/420,099, filed Dec. 6, 2010, which are each incorporated herein in its entirety by this reference thereto.

The present invention relates to audio processing and, in particular, to an apparatus and method for sound acquisition via the extraction of geometrical information from direction of arrival estimates.

BACKGROUND OF THE INVENTION

Traditional spatial sound recording aims at capturing a sound field with multiple microphones such that at the reproduction side, a listener perceives the sound image as it was at the recording location. Standard approaches for spatial sound recording usually use spaced, omnidirectional microphones, for example, in AB stereophony, or coincident directional microphones, for example, in intensity stereophony, or more sophisticated microphones, such as a B-format microphone, e.g. in Ambisonics, see, for example,

[1] R. K. Furness, "Ambisonics—An overview," in AES 8$^{th}$ International Conference, April 1990, pp. 181-189.

For the sound reproduction, these non-parametric approaches derive the desired audio playback signals (e.g., the signals to be sent to the loudspeakers) directly from the recorded microphone signals.

Alternatively, methods based on a parametric representation of sound fields can be applied, which are referred to as parametric spatial audio coders. These methods often employ microphone arrays to determine one or more audio downmix signals together with spatial side information describing the spatial sound. Examples are Directional Audio Coding (DirAC) or the so-called spatial audio microphones (SAM) approach. More details on DirAC can be found in

[2] Pulkki, V., "Directional audio coding in spatial sound reproduction and stereo upmixing," in Proceedings of the AES 28$^{th}$ International Conference, pp. 251-258, Piteå, Sweden, Jun. 30-Jul. 2, 2006,

[3] V. Pulkki, "Spatial sound reproduction with directional audio coding," J. Audio Eng. Soc., vol. 55, no. 6, pp. 503-516, June 2007.

For more details on the spatial audio microphones approach, reference is made to

[4] C. Faller: "Microphone Front-Ends for Spatial Audio Coders", in Proceedings of the AES 125$^{th}$ International Convention, San Francisco, October 2008.

In DirAC, for instance the spatial cue information comprises the direction-of-arrival (DOA) of sound and the diffuseness of the sound field computed in a time-frequency domain. For the sound reproduction, the audio playback signals can be derived based on the parametric description. In some applications, spatial sound acquisition aims at capturing an entire sound scene. In other applications spatial sound acquisition only aims at capturing certain desired components. Close talking microphones are often used for recording individual sound sources with high signal-to-noise ratio (SNR) and low reverberation, while more distant configurations such as XY stereophony represent a way for capturing the spatial image of an entire sound scene. More flexibility in terms of directivity can be achieved with beamforming, where a microphone array can be used to realize steerable pick-up patterns. Even more flexibility is provided by the above-mentioned methods, such as directional audio coding (DirAC) (see [2], [3]) in which it is possible to realize spatial filters with arbitrary pick-up patterns, as described in

[5] M. Kallinger, H. Ochsenfeld, G. Del Galdo, F. Küch, D. Mahne, R. Schultz-Amling. and O. Thiergart, "A spatial filtering approach for directional audio coding," in Audio Engineering Society Convention 126, Munich, Germany, May 2009, as well as other signal processing manipulations of the sound scene, see, for example,

[6] R. Schultz-Amling, F. Küch, O. Thiergart, and M. Kallinger, "Acoustical zooming based on a parametric sound field representation," in Audio Engineering Society Convention 128, London UK, May 2010,

[7] J. Herre, C. Falch, D. Mahne, G. Del Galdo, M. Kallinger, and O. Thiergart, "Interactive teleconferencing combining spatial audio object coding and DirAC technology," in Audio Engineering Society Convention 128, London UK, May 2010.

All the above-mentioned concepts have in common that the microphones are arranged in a fixed known geometry. The spacing between microphones is as small as possible for coincident microphonics, whereas it is normally a few centimeters for the other methods. In the following, we refer to any apparatus for the recording of spatial sound capable of retrieving direction of arrival of sound (e.g. a combination of directional microphones or a microphone array, etc.) as a spatial microphone.

Moreover, all the above-mentioned methods have in common that they are limited to a representation of the sound field with respect to only one point, namely the measurement location. Thus, the microphones that may be used may be placed at very specific, carefully selected positions, e.g. close to the sources or such that the spatial image can be captured optimally.

In many applications however, this is not feasible and therefore it would be beneficial to place several microphones further away from the sound sources and still be able to capture the sound as desired.

There exist several field reconstruction methods for estimating the sound field in a point in space other than where it was measured. One method is acoustic holography, as described in

[8] E. G. Williams, Fourier Acoustics: Sound Radiation and Nearfield Acoustical Holography, Academic Press, 1999.

Acoustic holography allows to compute the sound field at any point with an arbitrary volume given that the sound pressure and particle velocity is known on its entire surface. Therefore, when the volume is large, the number of sensors that may be used is unpractically large. Moreover, the method assumes that no sound sources are present inside the volume, making the algorithm unfeasible for our needs. The related wave field extrapolation (see also [8]) aims at extrapolating the known sound field on the surface of a volume to outer regions. The extrapolation accuracy however degrades rapidly for larger extrapolation distances as well as for extrapolations towards directions orthogonal to the direction of propagation of the sound, see

[9] A. Kuntz and R. Rabenstein. "Limitations in the extrapolation of wave fields from circular measurements," in 15th European Signal Processing Conference (EUSIPCO 2007), 2007.

[10] A. Walther and C. Faller, "Linear simulation of spaced microphone arrays using b-format recordings," in Audio Engineering Society Convention 128, London UK, May 2010, describes a plane wave model, wherein the field extrapolation is possible only in points far from the actual sound sources, e.g., close to the measurement point.

A major drawback of traditional approaches is that the spatial image recorded is relative to the spatial microphone used. In many applications, it is not possible or feasible to place a spatial microphone in the desired position, e.g., close to the sound sources. In this case, it would be more beneficial to place multiple spatial microphones further away from the sound scene and still be able to capture the sound as desired.

[11] US61/287,596: An Apparatus and a Method for Converting a First Parametric Spatial Audio Signal into a Second Parametric Spatial Audio Signal, proposes a method for virtually moving the real recording position to another position when reproduced over loudspeakers or headphones. However, this approach is limited to a simple sound scene in which all sound objects are assumed to have equal distance to the real spatial microphone used for the recording. Furthermore, the method can only take advantage of one spatial microphone.

SUMMARY

According to an embodiment, an apparatus for generating an audio output signal to simulate a recording of the audio output signal by a virtual microphone at a configurable virtual position in an environment may have: a sound events position estimator for estimating a sound event position indicating a position of a sound event in the environment, wherein the sound event is active at a certain time instant or in a certain time-frequency bin, wherein the sound event is a real sound source or a mirror image source, wherein the sound events position estimator is configured to estimate the sound event position indicating a position of a mirror image source in the environment when the sound event is a mirror image source, and wherein the sound events position estimator is adapted to estimate the sound event position based on a first direction information provided by a first real spatial microphone being located at a first real microphone position in the environment, and based on a second direction information provided by a second real spatial microphone being located at a second real microphone position in the environment, wherein the first real spatial microphone and the second real spatial microphone are spatial microphones which physically exist; and wherein the first real spatial microphone and the second real spatial microphone are apparatuses for acquisition of spatial sound capable of retrieving direction of arrival of sound, and an information computation module for generating the audio output signal based on a first recorded audio input signal, based on the first real microphone position, based on the virtual position of the virtual microphone, and based on the sound event position, wherein the first real spatial microphone is configured to record the first recorded audio input signal, or wherein a third microphone is configured to record the first recorded audio input signal, wherein the sound events position estimator is adapted to estimate the sound event position based on a first direction of arrival of the sound wave emitted by the sound event at the first real microphone position as the first direction information and based on a second direction of arrival of the sound wave at the second real microphone position as the second direction information, and wherein the information computation module includes a propagation compensator, wherein the propagation compensator is adapted to generate a first modified audio signal by modifying the first recorded audio input signal, based on a first amplitude decay between the sound event and the first real spatial microphone and based on a second amplitude decay between the sound event and the virtual microphone, by adjusting an amplitude value, a magnitude value or a phase value of the first recorded audio input signal, to acquire the audio output signal; or wherein the propagation compensator is adapted to generate a first modified audio signal by compensating a first time delay between an arrival of a sound wave emitted by the sound event at the first real spatial microphone and an arrival of the sound wave at the virtual microphone by adjusting an amplitude value, a magnitude value or a phase value of the first recorded audio input signal, to acquire the audio output signal.

According to another embodiment, a method for generating an audio output signal to simulate a recording of the audio output signal by a virtual microphone at a configurable virtual position in an environment may have the steps of: estimating a sound event position indicating a position of a sound event in the environment, wherein the sound event is active at a certain time instant or in a certain time-frequency bin, wherein the sound event is a real sound source or a mirror image source, wherein estimating the sound event position includes estimating the sound event position indicating a position of a mirror image source in the environment when the sound event is a mirror image source, and wherein estimating the sound event position is based on a first direction information provided by a first real spatial microphone being located at a first real microphone position in the environment, and based on a second direction information provided by a second real spatial microphone being located at a second real microphone position in the environment, wherein the first real spatial microphone and the second real spatial microphone are spatial microphones which physically exist; and wherein the first real spatial microphone and the second real spatial microphone are apparatuses for acquisition of spatial sound capable of retrieving direction of arrival of sound, and generating the audio output signal based on a first recorded audio input signal, based on the first real microphone position, based on the virtual position of the virtual microphone, and based on the sound event position, wherein the first real spatial microphone is configured to record the first recorded audio input signal, or wherein a third microphone is configured to record the first recorded audio input signal, wherein estimating the sound event position is conducted based on a first direction of arrival of the sound wave emitted by the sound event at the first real microphone position as the first direction information and based on a second direction of arrival of the sound wave at the second real microphone position as the second direction information, wherein generating the audio output signal includes generating a first modified audio signal by modifying the first recorded audio input signal, based on a first amplitude decay between the sound event and the first real spatial microphone and based on a second amplitude decay between the sound event and the virtual microphone, by adjusting an amplitude value, a magnitude value or a phase value of the first recorded audio input signal, to acquire the audio output signal; or wherein generating the audio output signal includes generating a first modified audio signal by compensating a first time delay between an arrival of a sound wave emitted by the sound event at the first real spatial microphone and an arrival of the sound wave at the virtual microphone by adjusting an amplitude value, a magnitude value or a phase value of the first recorded audio input signal, to acquire the audio output signal.

Another embodiment may have a computer program for implementing the method for generating an audio output signal to simulate a recording of the audio output signal by a virtual microphone at a configurable virtual position in an environment, which method may have the steps of: estimating a sound event position indicating a position of a sound event in the environment, wherein the sound event is active at a certain time instant or in a certain time-frequency bin, wherein the sound event is a real sound source or a mirror image source, wherein estimating the sound event position includes estimating the sound event position indicating a position of a mirror image source in the environment when the sound event is a mirror image source, and wherein estimating the sound event position is based on a first direction information provided by a first real spatial microphone being located at a first real microphone position in the environment, and based on a second direction information provided by a second real spatial microphone being located at a second real microphone position in the environment, wherein the first real spatial microphone and the second real spatial microphone are spatial microphones which physically exist; and wherein the first real spatial microphone and the second real spatial microphone are apparatuses for acquisition of spatial sound capable of retrieving direction of arrival of sound, and generating the audio output signal based on a first recorded audio input signal, based on the first real microphone position, based on the virtual position of the virtual microphone, and based on the sound event position, wherein the first real spatial microphone is configured to record the first recorded audio input signal, or wherein a third microphone is configured to record the first recorded audio input signal, wherein estimating the sound event position is conducted based on a first direction of arrival of the sound wave emitted by the sound event at the first real microphone position as the first direction information and based on a second direction of arrival of the sound wave at the second real microphone position as the second direction information, wherein generating the audio output signal includes generating a first modified audio signal by modifying the first recorded audio input signal, based on a first amplitude decay between the sound event and the first real spatial microphone and based on a second amplitude decay between the sound event and the virtual microphone, by adjusting an amplitude value, a magnitude value or a phase value of the first recorded audio input signal, to acquire the audio output signal; or wherein generating the audio output signal comprises generating a first modified audio signal by compensating a first time delay between an arrival of a sound wave emitted by the sound event at the first real spatial microphone and an arrival of the sound wave at the virtual microphone by adjusting an amplitude value, a magnitude value or a phase value of the first recorded audio input signal, to acquire the audio output signal, when being executed on a computer or a signal processor.

According to an embodiment, an apparatus for generating an audio output signal to simulate a recording of a virtual microphone at a configurable virtual position in an environment is provided. The apparatus comprises a sound events position estimator and an information computation module. The sound events position estimator is adapted to estimate a sound source position indicating a position of a sound source in the environment, wherein the sound events position estimator is adapted to estimate the sound source position based on a first direction information provided by a first real spatial microphone being located at a first real microphone position in the environment, and based on a second direction information provided by a second real spatial microphone being located at a second real microphone position in the environment.

The information computation module is adapted to generate the audio output signal based on a first recorded audio input signal being recorded by the first real spatial microphone, based on the first real microphone position, based on the virtual position of the virtual microphone, and based on the sound source position.

In an embodiment, the information computation module comprises a propagation compensator, wherein the propagation compensator is adapted to generate a first modified audio signal by modifying the first recorded audio input signal, based on a first amplitude decay between the sound source and the first real spatial microphone and based on a second amplitude decay between the sound source and the virtual microphone, by adjusting an amplitude value, a magnitude value or a phase value of the first recorded audio input signal, to obtain the audio output signal. In an embodiment, the first amplitude decay may be an amplitude decay of a sound wave emitted by a sound source and the second amplitude decay may be an amplitude decay of the sound wave emitted by the sound source.

According to another embodiment, the information computation module comprises a propagation compensator being adapted to generate a first modified audio signal by modifying the first recorded audio input signal by compensating a first delay between an arrival of a sound wave emitted by the sound source at the first real spatial microphone and an arrival of the sound wave at the virtual microphone by adjusting an amplitude value, a magnitude value or a phase value of the first recorded audio input signal, to obtain the audio output signal.

According to an embodiment, it is assumed to use two or more spatial microphones, which are referred to as real spatial microphones in the following. For each real spatial microphone, the DOA of the sound can be estimated in the time-frequency domain. From the information gathered by the real spatial microphones, together with the knowledge of their relative position, it is possible to constitute the output signal of an arbitrary spatial microphone virtually placed at will in the environment. This spatial microphone is referred to as virtual spatial microphone in the following.

Note that the Direction of Arrival (DOA) may be expressed as an azimuthal angle if 2D space, or by an azimuth and elevation angle pair in 3D. Equivalently, a unit norm vector pointed at the DOA may be used.

In embodiments, means are provided to capture sound in a spatially selective way, e.g., sound originating from a specific target location can be picked up, just as if a close-up "spot microphone" had been installed at this location. Instead of really installing this spot microphone, however, its output signal can be simulated by using two or more spatial microphones placed in other, distant positions.

The term "spatial microphone" refers to any apparatus for the acquisition of spatial sound capable of retrieving direction of arrival of sound (e.g. combination of directional microphones, microphone arrays, etc.).

The term "non-spatial microphone" refers to any apparatus that is not adapted for retrieving direction of arrival of sound, such as a single omnidirectional or directive microphone.

It should be noted, that the term "real spatial microphone" refers to a spatial microphone as defined above which physically exists.

Regarding the virtual spatial microphone, it should be noted, that the virtual spatial microphone can represent any desired microphone type or microphone combination, e.g. it can, for example, represent a single omnidirectional microphone, a directional microphone, a pair of directional microphones as used in common stereo microphones, but also a microphone array.

The present invention is based on the finding that when two or more real spatial microphones are used, it is possible to estimate the position in 2D or 3D space of sound events, thus, position localization can be achieved. Using the determined positions of the sound events, the sound signal that would have been recorded by a virtual spatial microphone placed and oriented arbitrarily in space can be computed, as well as the corresponding spatial side information, such as the Direction of Arrival from the point-of-view of the virtual spatial microphone.

For this purpose, each sound event may be assumed to represent a point like sound source, e.g. an isotropic point like sound source. In the following "real sound source" refers to an actual sound source physically existing in the recording environment, such as talkers or musical instruments etc. On the contrary, with "sound source" or "sound event" we refer in the following to an effective sound source, which is active at a certain time instant or in a certain time-frequency bin, wherein the sound sources may, for example, represent real sound sources or mirror image sources. According to an embodiment, it is implicitly assumed that the sound scene can be modeled as a multitude of such sound events or point like sound sources. Furthermore, each source may be assumed to be active only within a specific time and frequency slot in a predefined time-frequency representation. The distance between the real spatial microphones may be so, that the resulting temporal difference in propagation times is shorter than the temporal resolution of the time-frequency representation. The latter assumption guarantees that a certain sound event is picked up by all spatial microphones within the same time slot. This implies that the DOAs estimated at different spatial microphones for the same time-frequency slot indeed correspond to the same sound event. This assumption is not difficult to meet with real spatial microphones placed at a few meters from each other even in large rooms (such as living rooms or conference rooms) with a temporal resolution of even a few ms.

Microphone arrays may be employed to localize sound sources. The localized sound sources may have different physical interpretations depending on their nature. When the microphone arrays receive direct sound, they may be able to localize the position of a true sound source (e.g. talkers). When the microphone arrays receive reflections, they may localize the position of a mirror image source. Mirror image sources are also sound sources.

A parametric method capable of estimating the sound signal of a virtual microphone placed at an arbitrary location is provided. In contrast to the methods previously described, the proposed method does not aim directly at reconstructing the sound field, but rather aims at providing sound that is perceptually similar to the one which would be picked up by a microphone physically placed at this location. This may be achieved by employing a parametric model of the sound field based on point-like sound sources, e.g. isotropic point-like sound sources (IPLS). The geometrical information that may be used, namely the instantaneous position of all IPLS, may be obtained by conducting triangulation of the directions of arrival estimated with two or more distributed microphone arrays. This might be achieved, by obtaining knowledge of the relative position and orientation of the arrays. Notwithstanding, no a priori knowledge on the number and position of the actual sound sources (e.g. talkers) is necessary. Given the parametric nature of the proposed concepts, e.g. the proposed apparatus or method, the virtual microphone can possess an arbitrary directivity pattern as well as arbitrary physical or non-physical behaviors, e.g. with respect to the pressure decay with distance. The presented approach has been verified by studying the parameter estimation accuracy based on measurements in a reverberant environment.

While conventional recording techniques for spatial audio are limited in so far as the spatial image obtained is relative to the position in which the microphones have been physically placed, embodiments of the present invention take into account that in many applications, it is desired to place the microphones outside the sound scene and yet be able to capture the sound from an arbitrary perspective. According to embodiments, concepts are provided which virtually place a virtual microphone at an arbitrary point in space, by computing a signal perceptually similar to the one which would have been picked up, if the microphone had been physically placed in the sound scene. Embodiments may apply concepts, which may employ a parametric model of the sound field based on point-like sound sources, e.g. point-like isotropic sound sources. The geometrical information that may be used may be gathered by two or more distributed microphone arrays.

According to an embodiment, the sound events position estimator may be adapted to estimate the sound source position based on a first direction of arrival of the sound wave emitted by the sound source at the first real microphone position as the first direction information and based on a second direction of arrival of the sound wave at the second real microphone position as the second direction information.

In another embodiment, the information computation module may comprise a spatial side information computation module for computing spatial side information. The information computation module may be adapted to estimate the direction of arrival or an active sound intensity at the virtual microphone as spatial side information, based on a position vector of the virtual microphone and based on a position vector of the sound event.

According to a further embodiment, the propagation compensator may be adapted to generate the first modified audio signal in a time-frequency domain, by compensating the first delay or amplitude decay between the arrival of the sound wave emitted by the sound source at the first real spatial microphone and the arrival of the sound wave at the virtual microphone by adjusting said magnitude value of the first recorded audio input signal being represented in a time-frequency domain.

In an embodiment, the propagation compensator may be adapted to conduct propagation compensation by generating a modified magnitude value of the first modified audio signal by applying the formula:

$$P_v(k, n) = \frac{d_1(k, n)}{s(k, n)} P_{ref}(k, n)$$

wherein $d_1(k, n)$ is the distance between the position of the first real spatial microphone and the position of the sound event, wherein s(k, n) is the distance between the virtual position of the virtual microphone and the sound source position of the sound event, wherein $P_{ref}(k, n)$ is a magnitude value of the first recorded audio input signal being represented in a time-frequency domain, and wherein $P_v(k, n)$ is the modified magnitude value.

In a further embodiment, the information computation module may moreover comprise a combiner, wherein the propagation compensator may be furthermore adapted to modify a second recorded audio input signal, being recorded by the second real spatial microphone, by compensating a second delay or amplitude decay between an arrival of the sound wave emitted by the sound source at the second real spatial microphone and an arrival of the sound wave at the virtual microphone, by adjusting an amplitude value, a magnitude value or a phase value of the second recorded audio input signal to obtain a second modified audio signal, and wherein the combiner may be adapted to generate a combination signal by combining the first modified audio signal and the second modified audio signal, to obtain the audio output signal.

According to another embodiment, the propagation compensator may furthermore be adapted to modify one or more further recorded audio input signals, being recorded by the one or more further real spatial microphones, by compensating delays between an arrival of the sound wave at the virtual microphone and an arrival of the sound wave emitted by the sound source at each one of the further real spatial microphones. Each of the delays or amplitude decays may be compensated by adjusting an amplitude value, a magnitude value or a phase value of each one of the further recorded audio input signals to obtain a plurality of third modified audio signals. The combiner may be adapted to generate a combination signal by combining the first modified audio signal and the second modified audio signal and the plurality of third modified audio signals, to obtain the audio output signal.

In a further embodiment, the information computation module may comprise a spectral weighting unit for generating a weighted audio signal by modifying the first modified audio signal depending on a direction of arrival of the sound wave at the virtual position of the virtual microphone and depending on a virtual orientation of the virtual microphone to obtain the audio output signal, wherein the first modified audio signal may be modified in a time-frequency domain.

Moreover, the information computation module may comprise a spectral weighting unit for generating a weighted audio signal by modifying the combination signal depending on a direction of arrival or the sound wave at the virtual position of the virtual microphone and a virtual orientation of the virtual microphone to obtain the audio output signal, wherein the combination signal may be modified in a time-frequency domain.

According to another embodiment, the spectral weighting unit may be adapted to apply the weighting factor $$\alpha+(1-\alpha)\cos(\phi_v(k,n)), \text{ or the weighting factor}$$

$$0.5+0.5\cos(\phi_v(k,n))$$

on the weighted audio signal, wherein $\phi_v(k, n)$ indicates a direction of arrival vector of the sound wave emitted by the sound source at the virtual position of the virtual microphone.

In an embodiment, the propagation compensator is furthermore adapted to generate a third modified audio signal by modifying a third recorded audio input signal recorded by an omnidirectional microphone by compensating a third delay or amplitude decay between an arrival of the sound wave emitted by the sound source at the omnidirectional microphone and an arrival of the sound wave at the virtual microphone by adjusting an amplitude value, a magnitude value or a phase value of the third recorded audio input signal, to obtain the audio output signal.

In a further embodiment, the sound events position estimator may be adapted to estimate a sound source position in a three-dimensional environment.

Moreover, according to another embodiment, the information computation module may further comprise a diffuseness computation unit being adapted to estimate a diffuse sound energy at the virtual microphone or a direct sound energy at the virtual microphone.

The diffuseness computation unit may, according to a further embodiment, be adapted to estimate the diffuse sound energy $E_{diff}^{(VM)}$ at the virtual microphone by applying the formula:

$$E_{diff}^{(VM)} = \frac{1}{N}\sum_{i=1}^{N} E_{diff}^{(SMi)}$$

wherein N is the number of a plurality of real spatial microphones comprising the first and the second real spatial microphone, and wherein $E_{diff}^{(SMi)}$ is the diffuse sound energy at the i-th real spatial microphone.

In a further embodiment, the diffuseness computation unit may be adapted to estimate the direct sound energy by applying the formula:

$$\psi^{(VM)} = \frac{E_{diff}^{(VM)}}{E_{diff}^{(VM)} + E_{dir}^{(VM)}}$$

wherein "distance SMi−IPLS" is the distance between a position of the i-th real microphone and the sound source position, wherein "distance VM−IPLS" is the distance between the virtual position and the sound source position, and wherein $E_{dir}^{(SMi)}$ is the direct energy at the i-th real spatial microphone.

Moreover, according to another embodiment, the diffuseness computation unit may furthermore be adapted to estimate the diffuseness at the virtual microphone by estimating the diffuse sound energy at the virtual microphone and the direct sound energy at the virtual microphone and by applying the formula:

$$\psi^{(VM)} = \frac{E_{diff}^{(VM)}}{E_{diff}^{(VM)} + E_{dir}^{(VM)}}$$

wherein $\psi^{(VM)}$ indicates the diffuseness at the virtual microphone being estimated, wherein $E_{diff}^{(VM)}$ indicates the diffuse sound energy being estimated and wherein $E_{dir}^{(VM)}$ indicates the direct sound energy being estimated.

BRIEF DESCRIPTION OF THE DRAWINGS

Embodiments of the present invention will be detailed subsequently referring to the appended drawings, in which.

DETAILED DESCRIPTION OF THE INVENTION

Figure 1:
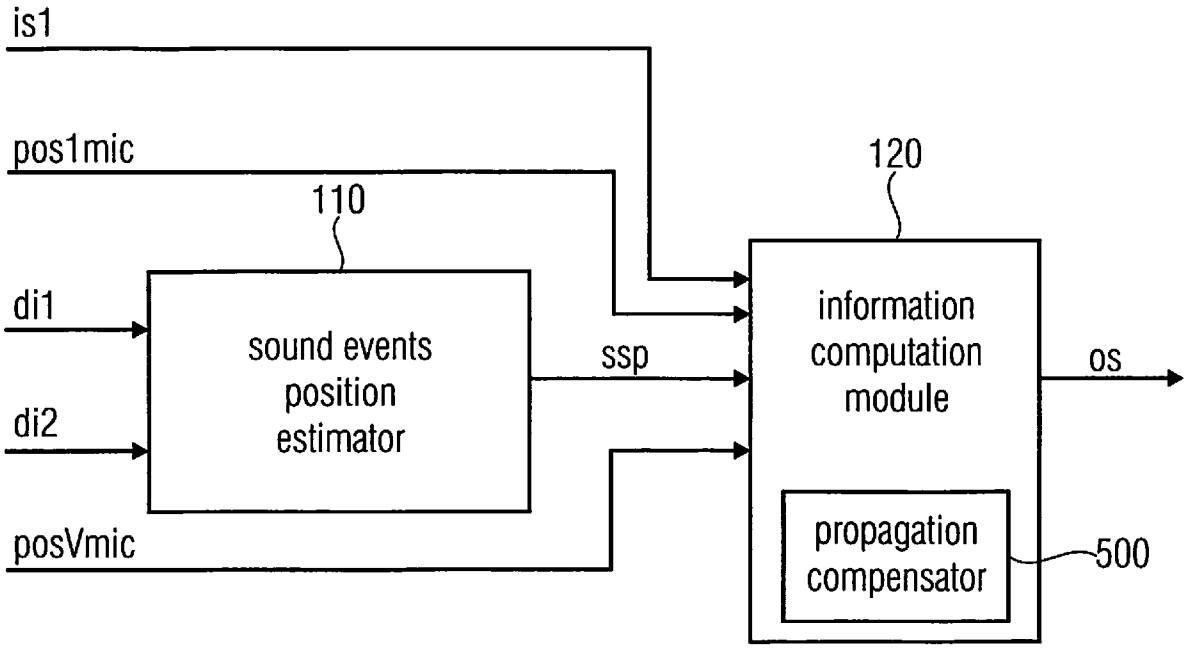
FIG. 1 illustrates an apparatus for generating an audio output signal according to an embodiment.

FIG. 1 illustrates an apparatus for generating an audio output signal to simulate a recording of a virtual microphone at a configurable virtual position posVmic in an environment. The apparatus comprises a sound events position estimator 110 and an information computation module 120. The sound events position estimator 110 receives a first direction information di1 from a first real spatial microphone and a second direction information di2 from a second real spatial microphone. The sound events position estimator 110 is adapted to estimate a sound source position ssp indicating a position of a sound source in the environment, the sound source emitting a sound wave, wherein the sound events position estimator 110 is adapted to estimate the sound source position ssp based on a first direction information di1 provided by a first real spatial microphone being located at a first real microphone position pos1mic in the environment, and based on a second direction information di2 provided by a second real spatial microphone being located at a second real microphone position in the environment. The information computation module 120 is adapted to generate the audio output signal based on a first recorded audio input signal is1 being recorded by the first real spatial microphone, based on the first real microphone position pos1mic and based on the virtual position posVmic of the virtual microphone. The information computation module 120 comprises a propagation compensator being adapted to generate a first modified audio signal by modifying the first recorded audio input signal is1 by compensating a first delay or amplitude decay between an arrival of the sound wave emitted by the sound source at the first real spatial microphone and an arrival of the sound wave at the virtual microphone by adjusting an amplitude value, a magnitude value or a phase value of the first recorded audio input signal is1, to obtain the audio output signal.

Figure 2:
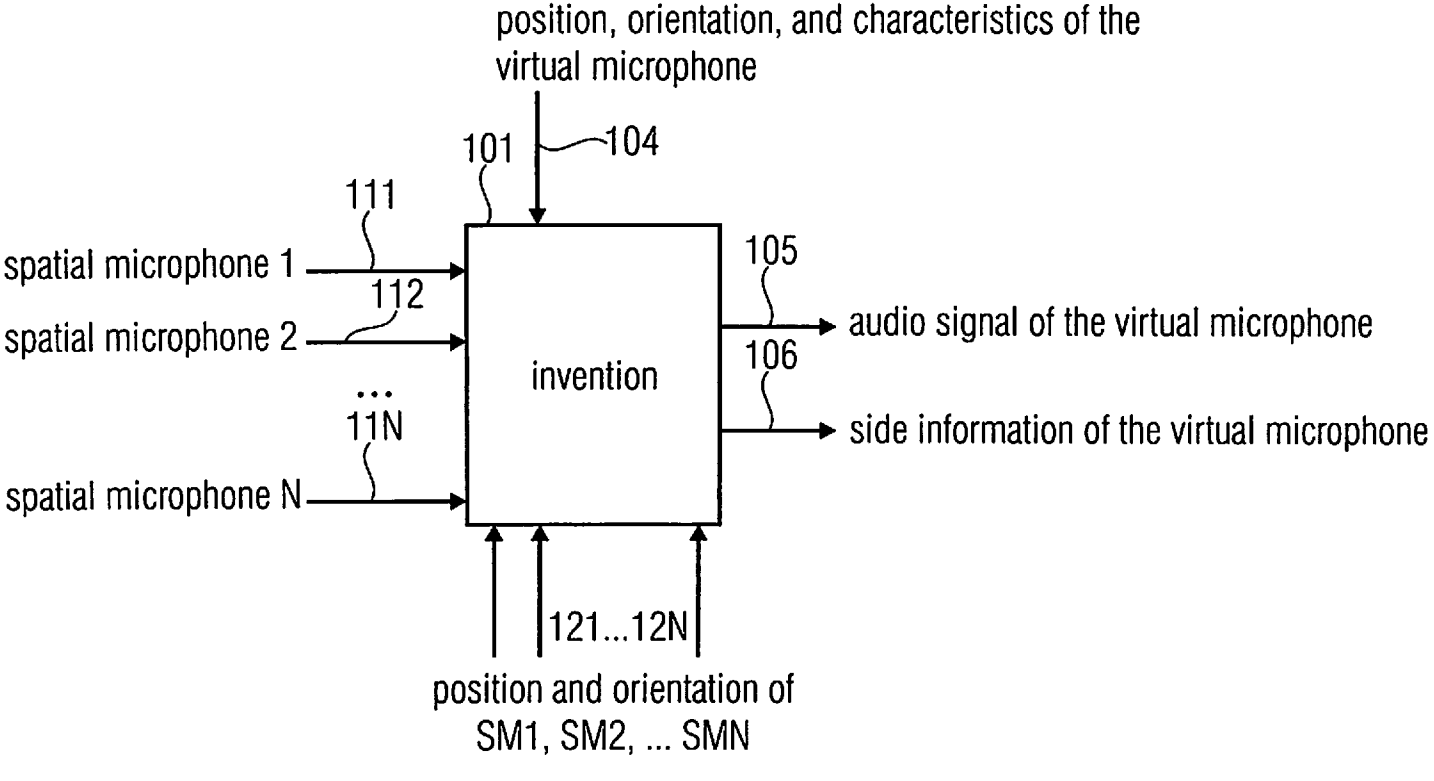
FIG. 2 illustrates the inputs and outputs of an apparatus and a method for generating an audio output signal according to an embodiment.

FIG. 2 illustrates the inputs and outputs of an apparatus and a method according to an embodiment. Information from two or more real spatial microphones 111, 112, . . . , 11N is fed to the apparatus/is processed by the method. This information comprises audio signals picked up by the real spatial microphones as well as direction information from the real spatial microphones, e.g. direction of arrival (DOA) estimates. The audio signals and the direction information, such as the direction of arrival estimates may be expressed in a time-frequency domain. If, for example, a 2D geometry reconstruction is desired and a traditional STFT (short time Fourier transformation) domain is chosen for the representation of the signals, the DOA may be expressed as azimuth angles dependent on k and n, namely the frequency and time indices.

In embodiments, the sound event localization in space, as well as describing the position of the virtual microphone may be conducted based on the positions and orientations of the real and virtual spatial microphones in a common coordinate system. This information may be represented by the inputs 121 . . . 12N and input 104 in FIG. 2. The input 104 may additionally specify the characteristic of the virtual spatial microphone, e.g., its position and pick-up pattern, as will be discussed in the following. If the virtual spatial microphone comprises multiple virtual sensors, their positions and the corresponding different pick-up patterns may be considered.

The output of the apparatus or a corresponding method may be, when desired, one or more sound signals 105, which may have been picked up by a spatial microphone defined and placed as specified by 104. Moreover, the apparatus (or rather the method) may provide as output corresponding spatial side information 106 which may be estimated by employing the virtual spatial microphone.

Figure 3:
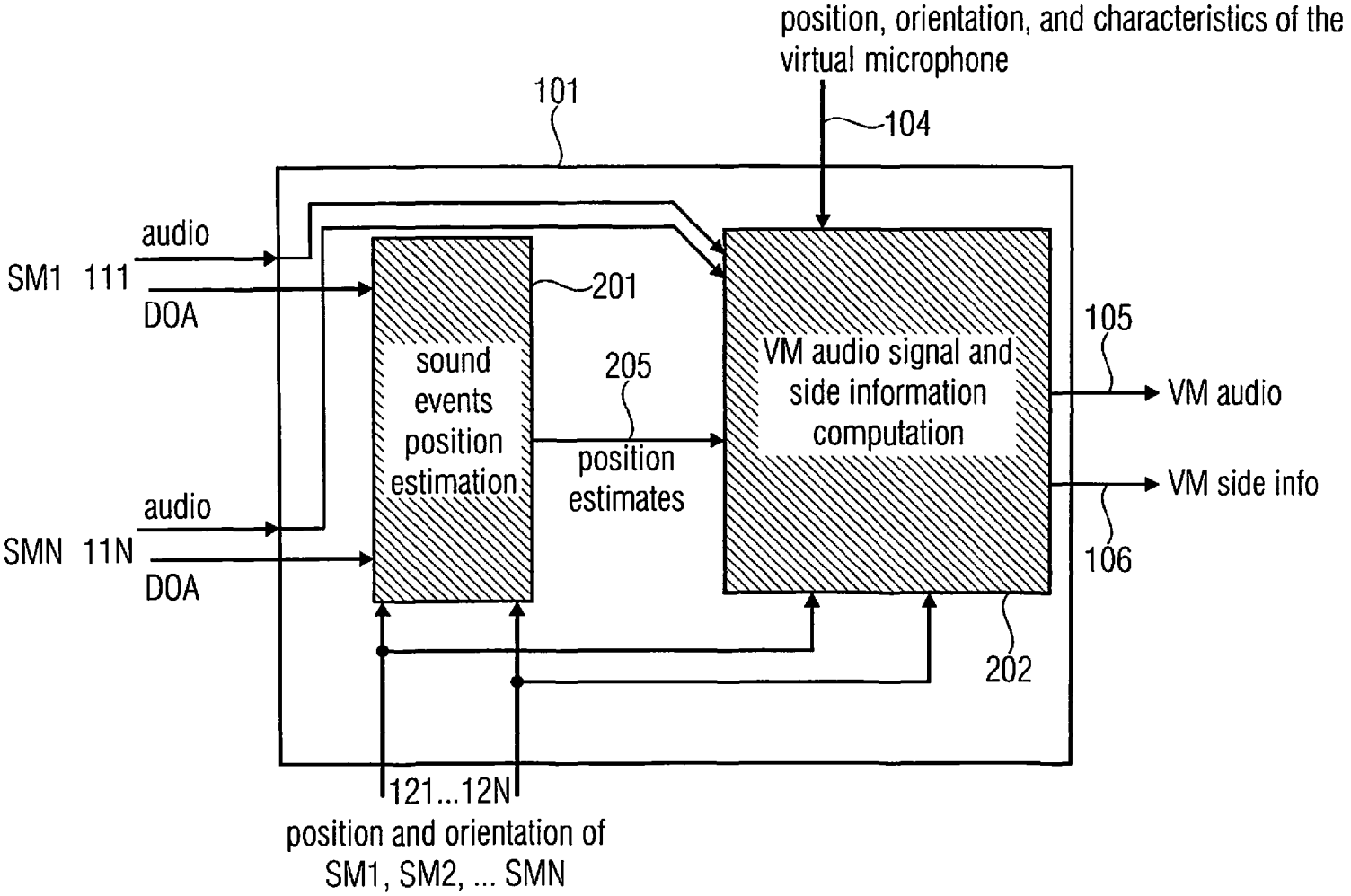
FIG. 3 illustrates the basic structure of an apparatus according to an embodiment which comprises a sound events position estimatior and an information computation module.

FIG. 3 illustrates an apparatus according to an embodiment, which comprises two main processing units, a sound events position estimator 201 and an information computation module 202. The sound events position estimator 201 may carry out geometrical reconstruction on the basis of the DOAs comprised in inputs 111 . . . 11N and based on the knowledge of the position and orientation of the real spatial microphones, where the DOAs have been computed. The output of the sound events position estimator 205 comprises the position estimates (either in 2D or 3D) of the sound sources where the sound events occur for each time and frequency bin. The second processing block 202 is an information computation module. According to the embodiment of FIG. 3, the second processing block 202 computes a virtual microphone signal and spatial side information. It is therefore also referred to as virtual microphone signal and side information computation block 202. The virtual microphone signal and side information computation block 202 uses the sound events' positions 205 to process the audio signals comprised in 111 . . . 11N to output the virtual microphone audio signal 105. Block 202, if need be, may also compute the spatial side information 106 corresponding to the virtual spatial microphone. Embodiments below illustrate possibilities, how blocks 201 and 202 may operate.

In the following, position estimation of a sound events position estimator according to an embodiment is described in more detail.

Depending on the dimensionality of the problem (2D or 3D) and the number of spatial microphones, several solutions for the position estimation are possible.

Figure 4:
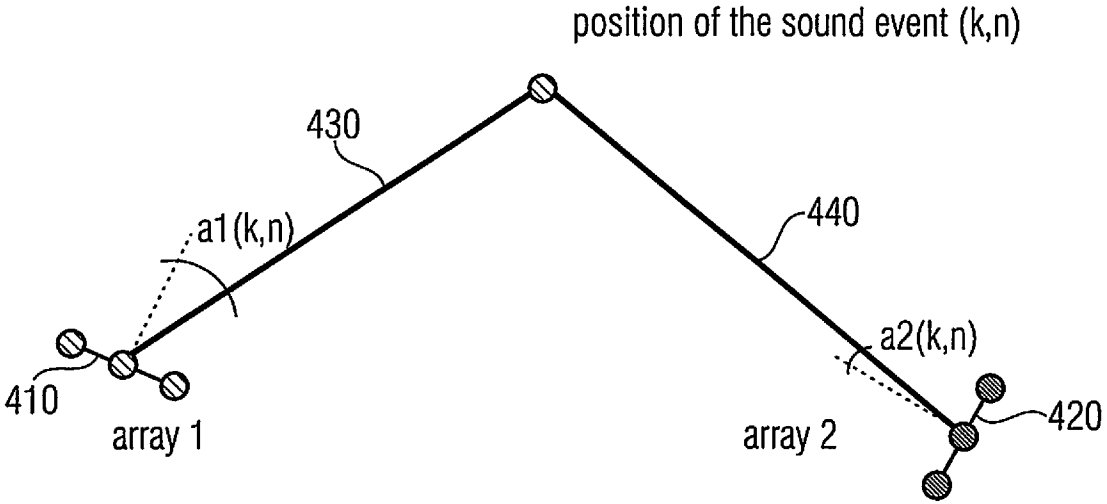
FIG. 4 shows an exemplary scenario in which the real spatial microphones are depicted as Uniform Linear Arrays of 3 microphones each.

If two spatial microphones in 2D exist, (the simplest possible case) a simple triangulation is possible. FIG. 4 shows an exemplary scenario in which the real spatial microphones are depicted as Uniform Linear Arrays (ULAs) of 3 microphones each. The DOA, expressed as the azimuth angles a1(*k, n*) and a2(*k, n*), are computed for the time-frequency bin (k, n). This is achieved by employing a proper DOA estimator, such as ESPRIT,

[13] R. Roy, A. Paulraj, and T. Kailath, "Direction-of-arrival estimation by subspace rotation methods—ESPRIT," in IEEE International Conference on Acoustics, Speech, and Signal Processing (ICASSP), Stanford, Calif., USA, April 1986, or (root) MUSIC, see

[14] R. Schmidt, "Multiple emitter location and signal parameter estimation," IEEE Transactions on Antennas and Propagation, vol. 34, no. 3, pp. 276-280, 1986 to the pressure signals transformed into the time-frequency domain.

In FIG. 4, two real spatial microphones, here, two real spatial microphone arrays 410, 420 are illustrated. The two estimated DOAs a1(*k, n*) and a2(*k, n*) are represented by two lines, a first line 430 representing DOA a1(*k, n*) and a second line 440 representing DOA a2(*k, n*). The triangulation is possible via simple geometrical considerations knowing the position and orientation of each array.

The triangulation fails when the two lines 430, 440 are exactly parallel. In real applications, however, this is very unlikely. However, not all triangulation results correspond to a physical or feasible position for the sound event in the considered space. For example, the estimated position of the sound event might be too far away or even outside the assumed space, indicating that probably the DOAs do not correspond to any sound event which can be physically interpreted with the used model. Such results may be caused by sensor noise or too strong room reverberation. Therefore, according to an embodiment, such undesired results are flagged such that the information computation module 202 can treat them properly.

Figure 5:
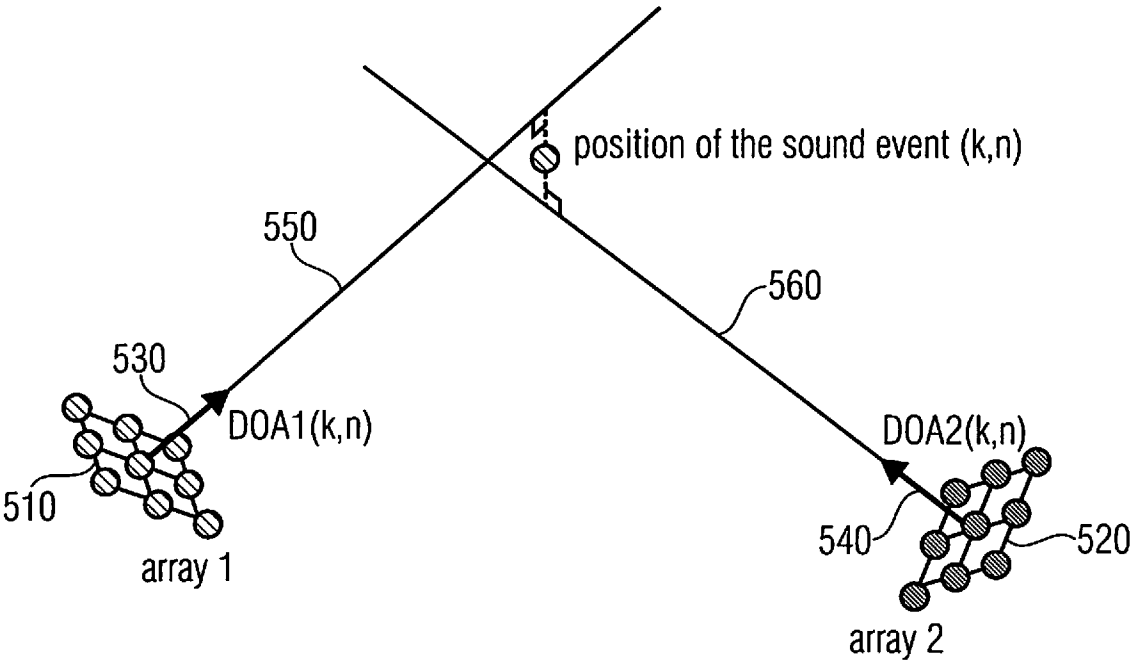
FIG. 5 depicts two spatial microphones in 3D for estimating the direction of arrival in 3D space.

FIG. 5 depicts a scenario, where the position of a sound event is estimated in 3D space. Proper spatial microphones are employed, for example, a planar or 3D microphone array. In FIG. 5, a first spatial microphone 510, for example, a first 3D microphone array, and a second spatial microphone 520, e.g., a first 3D microphone array, is illustrated. The DOA in the 3D space, may for example, be expressed as azimuth and elevation. Unit vectors 530, 540 may be employed to express the DOAs. Two lines 550, 560 are projected according to the DOAs. In 3D, even with very reliable estimates, the two lines 550, 560 projected according to the DOAs might not intersect. However, the triangulation can still be carried out, for example, by choosing the middle point of the smallest segment connecting the two lines.

Similarly to the 2D case, the triangulation may fail or may yield unfeasible results for certain combinations of directions, which may then also be flagged, e.g. to the information computation module 202 of FIG. 3.

If more than two spatial microphones exist, several solutions are possible. For example, the triangulation explained above, could be carried out for all pairs of the real spatial microphones (if N=3, 1 with 2, 1 with 3, and 2 with 3). The resulting positions may then be averaged (along x and y, and, if 3D is considered, z).

Alternatively, more complex concepts may be used. For example, probabilistic approaches may be applied as described in

[15] J. Michael Steele, "Optimal Triangulation of Random Samples in the Plane", The Annals of Probability, Vol. 10, No. 3 (August, 1982), pp. 548-553.

According to an embodiment, the sound field may be analyzed in the time-frequency domain, for example, obtained via a short-time Fourier transform (STFT), in which k and n denote the frequency index k and time index n, respectively. The complex pressure $P_v(k, n)$ at an arbitrary position $p_v$ for a certain k and n is modeled as a single spherical wave emitted by a narrow-band isotropic point-like source, e.g. by employing the formula:

$$P_v(k,n)=P_{IPLS}(k,n)\cdot\gamma(k,p_{IPLS}(k,n),p_v), \quad (1)$$

where $P_{IPLS}(k, n)$ is the signal emitted by the IPLS at its position $p_{IPLS}(k, n)$. The complex factor $\gamma(k, p_{IPLS}, p_v)$ expresses the propagation from $p_{IPLS}(k, n)$ to $p_v$, e.g., it introduces appropriate phase and magnitude modifications. Here, the assumption may be applied that in each time-frequency bin only one IPLS is active. Nevertheless, multiple narrow-band IPLSs located at different positions may also be active at a single time instance.

Each IPLS either models direct sound or a distinct room reflection. Its position $p_{IPLS}(k, n)$ may ideally correspond to an actual sound source located inside the room, or a mirror image sound source located outside, respectively. Therefore, the position $p_{IPLS}(k, n)$ may also indicates the position of a sound event.

Please note that the term "real sound sources" denotes the actual sound sources physically existing in the recording environment, such as talkers or musical instruments. On the contrary, with "sound sources" or "sound events" or "IPLS" we refer to effective sound sources, which are active at certain time instants or at certain time-frequency bins, wherein the sound sources may, for example, represent real sound sources or mirror image sources.

Figure 15A:
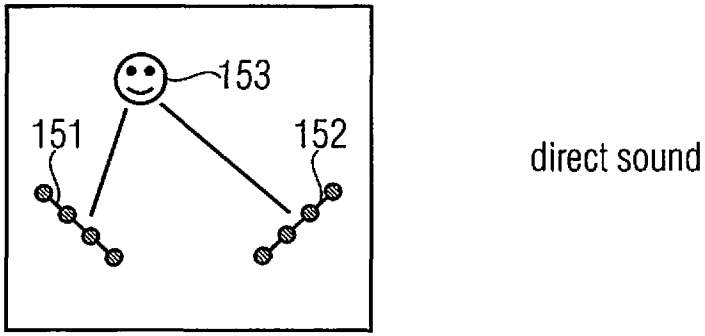
FIG. 15*a*-15*c* illustrate scenarios where two microphone arrays receive direct sound, sound reflected by a wall and diffuse sound.
Figure 15B:
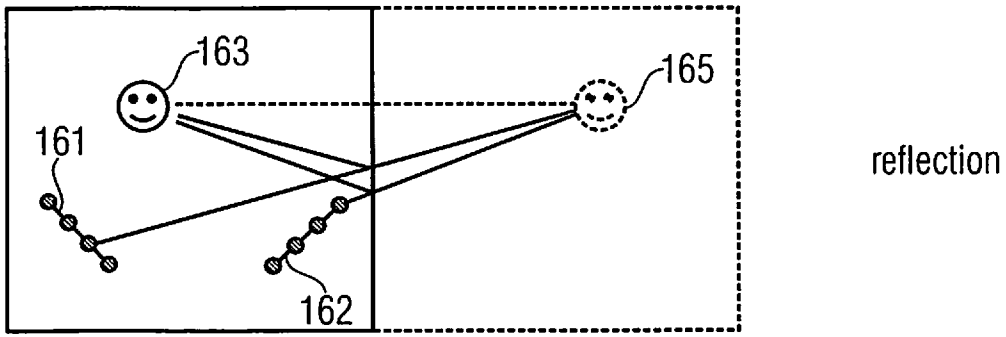

FIG. 15*a*-15*b* illustrate microphone arrays localizing sound sources. The localized sound sources may have different physical interpretations depending on their nature. When the microphone arrays receive direct sound, they may be able to localize the position of a true sound source (e.g. talkers). When the microphone arrays receive reflections, they may localize the position of a mirror image source. Mirror image sources are also sound sources.

FIG. 15*a* illustrates a scenario, where two microphone arrays 151 and 152 receive direct sound from an actual sound source (a physically existing sound source) 153.

FIG. 15*b* illustrates a scenario, where two microphone arrays 161, 162 receive reflected sound, wherein the sound has been reflected by a wall. Because of the reflection, the microphone arrays 161, 162 localize the position, where the sound appears to come from, at a position of an mirror image source 165, which is different from the position of the speaker 163.

Both the actual sound source 153 of FIG. 15*a*, as well as the mirror image source 165 are sound sources.

Figure 15C:
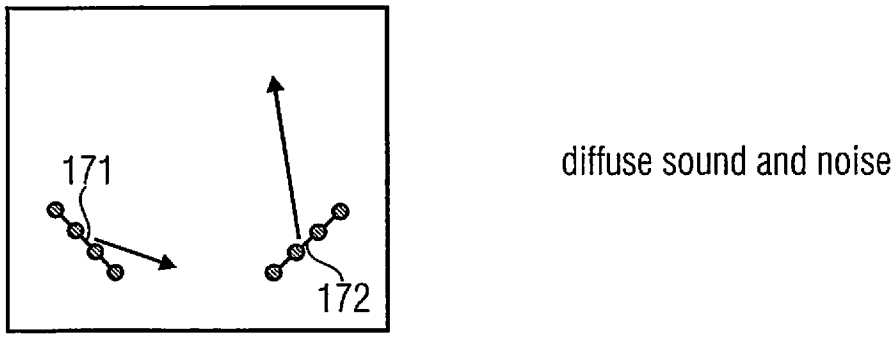

FIG. 15*c* illustrates a scenario, where two microphone arrays 171, 172 receive diffuse sound and are not able to localize a sound source.

While this single-wave model is accurate only for mildly reverberant environments given that the source signals fulfill the W-disjoint orthogonality (WDO) condition, i.e. the time-frequency overlap is sufficiently small. This is normally true for speech signals, see, for example,

[12] S. Rickard and Z. Yilmaz, "On the approximate W-disjoint orthogonality of speech," in Acoustics, Speech and Signal Processing, 2002. ICASSP 2002. IEEE International Conference on, April 2002, vol. 1.

However, the model also provides a good estimate for other environments and is therefore also applicable for those environments.

In the following, the estimation of the positions $p_{IPLS}(k, n)$ according to an embodiment is explained. The position $p_{IPLS}(k, n)$ of an active IPLS in a certain time-frequency bin, and thus the estimation of a sound event in a time-frequency bin, is estimated via triangulation on the basis of the direction of arrival (DOA) of sound measured in at least two different observation points.

Figure 6:
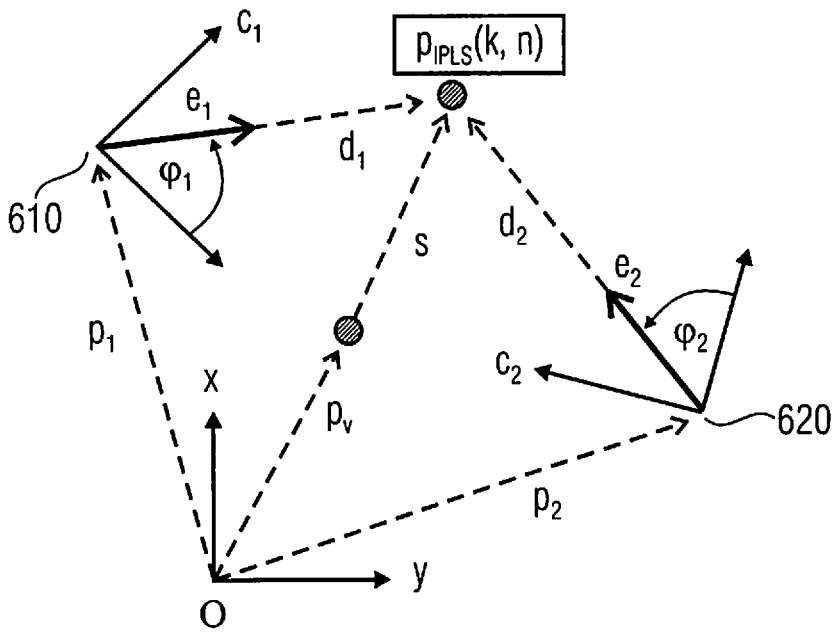
FIG. 6 illustrates a geometry where an isotropic point-like sound source of the current time-frequency bin (k, n) is located at a position $p_{IPLS}(k, n)$.

FIG. 6 illustrates a geometry, where the IPLS of the current time-frequency slot (k, n) is located in the unknown position $p_{IPLS}(k, n)$. In order to determine the DOA information that may be used, two real spatial microphones, here, two microphone arrays, are employed having a known geometry, position and orientation, which are placed in positions 610 and 620, respectively. The vectors $p_1$ and $p_2$ point to the positions 610, 620, respectively. The array orientations are defined by the unit vectors $c_1$ and $c_2$. The DOA of the sound is determined in the positions 610 and 620 for each (k, n) using a DOA estimation algorithm, for instance as provided by the DirAC analysis (see [2], [3]). By this, a first point-of-view unit vector $e_1^{POV}(k, n)$ and a second point-of-view unit vector $e_2^{POV}(k, n)$ with respect to a point of view of the microphone arrays (both not shown in FIG. 6) may be provided as output of the DirAC analysis. For example, when operating in 2D, the first point-of-view unit vector results to:

$$e_1^{POV}(k, n) = \begin{bmatrix} \cos(\varphi_1(k, n)) \\ \sin(\varphi_1(k, n)) \end{bmatrix}, \tag{2}$$

Here, $\phi_1(k, n)$ represents the azimuth of the DOA estimated at the first microphone array, as depicted in FIG. 6. The corresponding DOA unit vectors $e_1(k, n)$ and $e_2(k, n)$, with respect to the global coordinate system in the origin, may be computed by applying the formulae:

$$e_1(k,n)=R_1 \cdot e_1^{POV}(k,n),$$

$$e_2(k,n)=R_2 \cdot e_2^{POV}(k,n), \tag{3}$$

where R are coordinate transformation matrices, e.g., $$R_1 = \begin{bmatrix} c_{1,x} & -c_{1,y} \\ c_{1,y} & c_{1,x} \end{bmatrix}, \tag{4}$$

when operating in 2D and $c_1=[c_{1,x}, c_{1,y}]^T$. For carrying out the triangulation, the direction vectors $d_1(k, n)$ and $d_2(k, n)$ may be calculated as:

$$d_1(k,n)=d_1(k,n)e_1(k,n),$$

$$d_2(k,n)=d_2(k,n)e_2(k,n), \tag{5}$$

where $d_1(k, n)=\|d_1(k, n)\|$ and $d_2(k, n)=\|d_2(k, n)\|$ are the unknown distances between the IPLS and the two microphone arrays. The following equation $$p_1+d_1(k,n)=p_2+d_2(k,n) \tag{6}$$

may be solved for $d_1(k, n)$. Finally, the position $p_{IPLS}(k, n)$ of the IPLS is given by $$p_{IPLS}(k,n)=d_1(k,n)e_1(k,n)+p_1. \tag{7}$$

In another embodiment, equation (6) may be solved for $d_2(k, n)$ and $p_{IPLS}(k, n)$ is analogously computed employing $d_2(k, n)$.

Equation (6) provides a solution when operating in 2D, unless $e_1(k, n)$ and $e_2(k, n)$ are parallel. However, when using more than two microphone arrays or when operating in 3D, a solution cannot be obtained when the direction vectors d do not intersect. According to an embodiment, in this case, the point which is closest to all direction vectors d is be computed and the result can be used as the position of the IPLS.

In an embodiment, all observation points $p_1, p_2, \ldots$ should be located such that the sound emitted by the IPLS falls into the same temporal block n. This requirement may simply be fulfilled when the distance Δ between any two of the observation points is smaller than $$\Delta_{max} = c\frac{n_{FFT}(1-R)}{f_s}, \tag{8}$$

where $n_{FFT}$ is the SIFT window length, $0 \le R < 1$ specifies the overlap between successive time frames and $f_s$ is the sampling frequency. For example, for a 1024-point SIFT at 48 kHz with 50% overlap (R=0.5), the maximum spacing between the arrays to fulfill the above requirement is Δ=3.65 m.

In the following, an information computation module 202, e.g. a virtual microphone signal and side information computation module, according to an embodiment is described in more detail.

Figure 7:
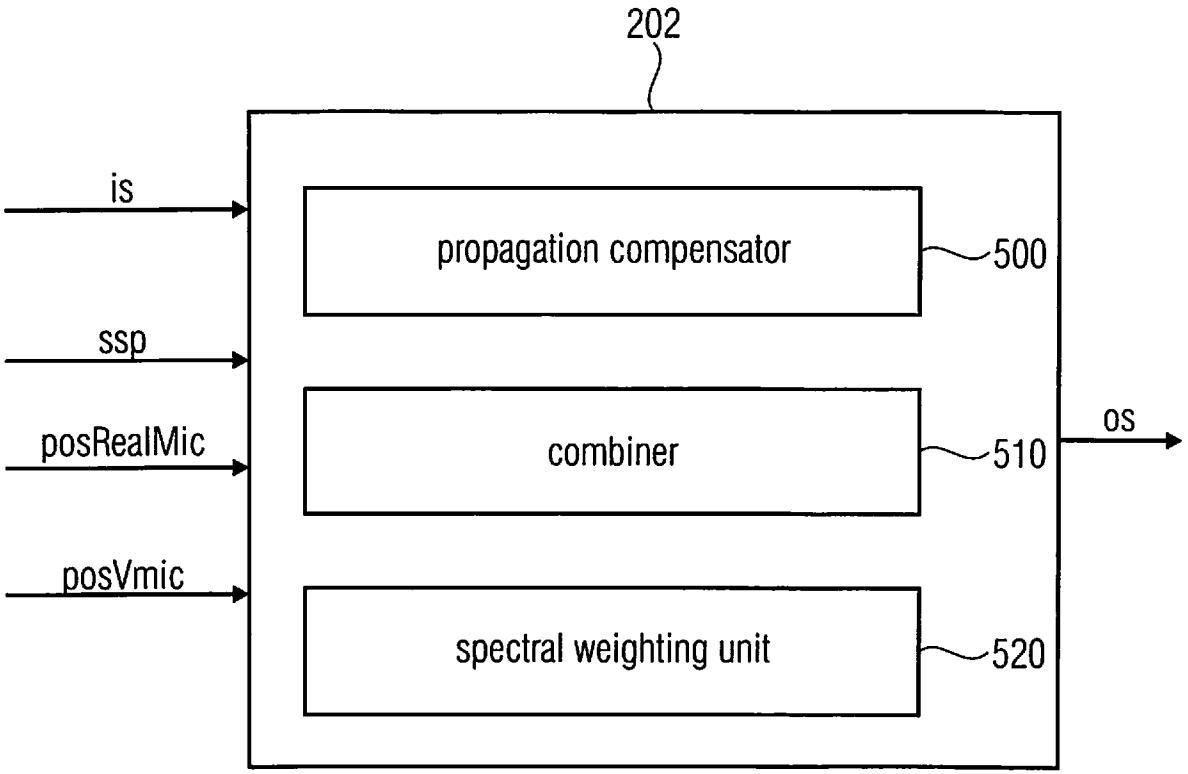
FIG. 7 depicts the information computation module according to an embodiment.

FIG. 7 illustrates a schematic overview of an information computation module 202 according to an embodiment. The information computation unit comprises a propagation compensator 500, a combiner 510 and a spectral weighting unit 520. The information computation module 202 receives the sound source position estimates ssp estimated by a sound events position estimator, one or more audio input signals is recorded by one or more of the real spatial microphones, positions posRealMic of one or more of the real spatial microphones, and the virtual position posVmic of the virtual microphone. It outputs an audio output signal os representing an audio signal of the virtual microphone.

Figure 8:
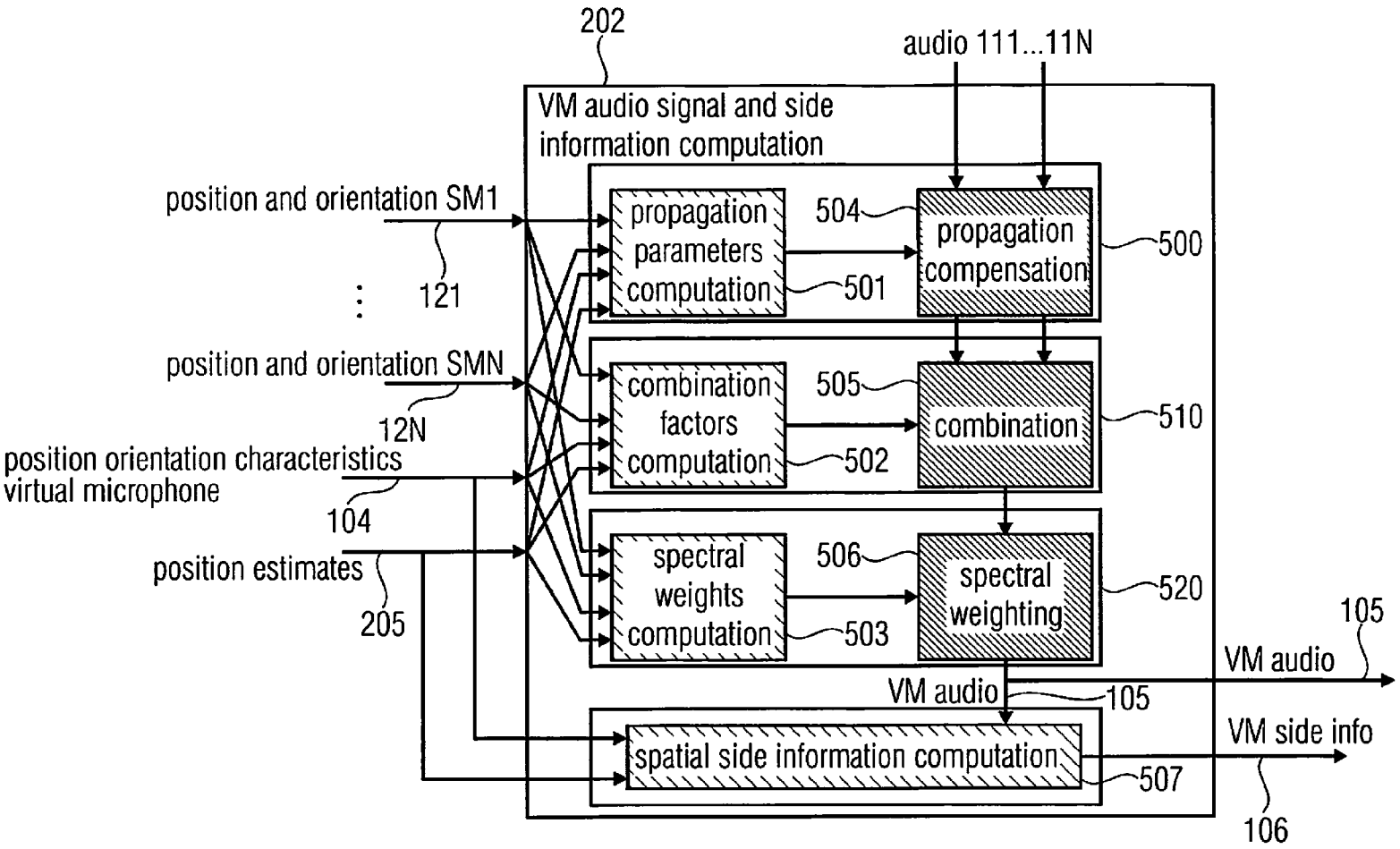
FIG. 8 depicts the information computation module according to another embodiment.

FIG. 8 illustrates an information computation module according to another embodiment. The information computation module of FIG. 8 comprises a propagation compensator 500, a combiner 510 and a spectral weighting unit 520. The propagation compensator 500 comprises a propagation parameters computation module 501 and a propagation compensation module 504. The combiner 510 comprises a combination factors computation module 502 and a combination module 505. The spectral weighting unit 520 comprises a spectral weights computation unit 503, a spectral weighting application module 506 and a spatial side information computation module 507.

To compute the audio signal of the virtual microphone, the geometrical information, e.g. the position and orientation of the real spatial microphones 121 . . . 12N, the position, orientation and characteristics of the virtual spatial microphone 104, and the position estimates of the sound events 205 are fed into the information computation module 202, in particular, into the propagation parameters computation module 501 of the propagation compensator 500, into the combination factors computation module 502 of the combiner 510 and into the spectral weights computation unit 503 of the spectral weighting unit 520. The propagation parameters computation module 501, the combination factors computation module 502 and the spectral weights computation unit 503 compute the parameters used in the modification of the audio signals 111 . . . 11N in the propagation compensation module 504, the combination module 505 and the spectral weighting application module 506.

In the information computation module 202, the audio signals 111 . . . 11N may at first be modified to compensate for the effects given by the different propagation lengths between the sound event positions and the real spatial microphones. The signals may then be combined to improve for instance the signal-to-noise ratio (SNR). Finally, the resulting signal may then be spectrally weighted to take the directional pick up pattern of the virtual microphone into account, as well as any distance dependent gain function. These three steps are discussed in more detail below.

Propagation compensation is now explained in more detail. In the upper portion of FIG. 9, two real spatial microphones (a first microphone array 910 and a second microphone array 920), the position of a localized sound event 930 for time-frequency bin (k, n), and the position of the virtual spatial microphone 940 are illustrated.

Figure 9:
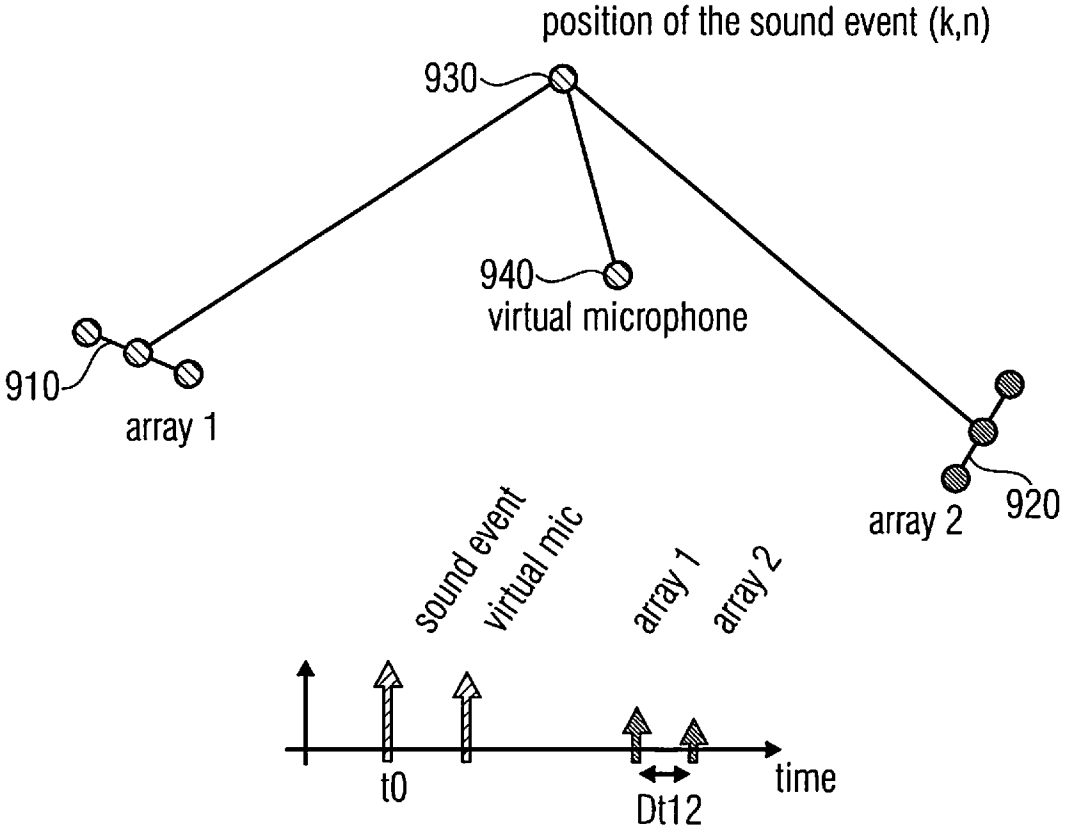
FIG. 9 shows two real spatial microphones, a localized sound event and a position of a virtual spatial microphone, together with the corresponding delays and amplitude decays.

The lower portion of FIG. 9 depicts a temporal axis. It is assumed that a sound event is emitted at time t0 and then propagates to the real and virtual spatial microphones. The time delays of arrival as well as the amplitudes change with distance, so that the further the propagation length, the weaker the amplitude and the longer the time delay of arrival are.

The signals at the two real arrays are comparable only if the relative delay Dt12 between them is small. Otherwise, one of the two signals needs to be temporally realigned to compensate the relative delay Dt12, and possibly, to be scaled to compensate for the different decays.

Compensating the delay between the arrival at the virtual microphone and the arrival at the real microphone arrays (at one of the real spatial microphones) changes the delay independent from the localization of the sound event, making it superfluous for most applications.

Returning to FIG. 8, propagation parameters computation module 501 is adapted to compute the delays to be corrected for each real spatial microphone and for each sound event. If desired, it also computes the gain factors to be considered to compensate for the different amplitude decays.

The propagation compensation module 504 is configured to use this information to modify the audio signals accordingly. If the signals are to be shifted by a small amount of time (compared to the time window of the filter bank), then a simple phase rotation suffices. If the delays are larger, more complicated implementations may be used.

The output of the propagation compensation module 504 are the modified audio signals expressed in the original time-frequency domain.

In the following, a particular estimation of propagation compensation for a virtual microphone according to an embodiment will be described with reference to FIG. 6 which inter alia illustrates the position 610 of a first real spatial microphone and the position 620 of a second real spatial microphone.

In the embodiment that is now explained, it is assumed that at least a first recorded audio input signal, e.g. a pressure signal of at least one of the real spatial microphones (e.g. the microphone arrays) is available, for example, the pressure signal of a first real spatial microphone. We will refer to the considered microphone as reference microphone, to its position as reference position $p_{ref}$ and to its pressure signal as reference pressure signal $P_{ref}(k, n)$. However, propagation compensation may not only be conducted with respect to only one pressure signal, but also with respect to the pressure signals of a plurality or of all of the real spatial microphones.

The relationship between the pressure signal $P_{IPLS}(k, n)$ emitted by the IPLS and a reference pressure signal $P_{ref}(k, n)$ of a reference microphone located in $p_{ref}$ can be expressed by formula (9):

$$P_{ref}(k,n)=P_{IPLS}(k,n)\cdot\gamma(k,p_{IPLS},p_{ref}), \tag{9}$$

In general, the complex factor $\gamma(k, p_a, p_b)$ expresses the phase rotation and amplitude decay introduced by the propagation of a spherical wave from its origin in $p_a$ to $p_b$. However, practical tests indicated that considering only the amplitude decay in $\gamma$ leads to plausible impressions of the virtual microphone signal with significantly fewer artifacts compared to also considering the phase rotation.

The sound energy which can be measured in a certain point in space depends strongly on the distance r from the sound source, in FIG. 6 from the position $p_{IPLS}$ of the sound source. In many situations, this dependency can be modeled with sufficient accuracy using well-known physical principles, for example, the 1/r decay of the sound pressure in the far-field of a point source. When the distance of a reference microphone, for example, the first real microphone from the sound source is known, and when also the distance of the virtual microphone from the sound source is known, then, the sound energy at the position of the virtual microphone can be estimated from the signal and the energy of the reference microphone, e.g. the first real spatial microphone. This means, that the output signal of the virtual microphone can be obtained by applying proper gains to the reference pressure signal.

Assuming that the first real spatial microphone is the reference microphone, then $p_{ref}=p_1$. In FIG. 6, the virtual microphone is located in $p_v$. Since the geometry in FIG. 6 is known in detail, the distance $d_1(k, n)=\|d_1(k, n)\|$ between the reference microphone (in FIG. 6: the first real spatial microphone) and the IPLS can easily be determined, as well as the distance $s(k, n)=\|s(k, n)\|$ between the virtual microphone and the IPLS, namely $$s(k,n)=\|s(k,n)\|=\|p_1+d_1(k,n)-p_v\|. \tag{10}$$

The sound pressure $P_v(k, n)$ at the position of the virtual microphone is computed by combining formulas (1) and (9), leading to $$P_v(k, n) = \frac{\gamma(k, p_{IPLS}, p_v)}{\gamma(k, p_{IPLS}, p_{ref})} P_{ref}(k, n). \tag{11}$$

As mentioned above, in some embodiments, the factors $\gamma$ may only consider the amplitude decay due to the propagation. Assuming for instance that the sound pressure decreases with 1/r, then $$P_v(k, n) = \frac{d_1(k, n)}{s(k, n)} P_{ref}(k, n). \tag{12}$$

When the model in formula (1) holds, e.g., when only direct sound is present, then formula (12) can accurately reconstruct the magnitude information. However, in case of pure diffuse sound fields, e.g., when the model assumptions are not met, the presented method yields an implicit dereverberation of the signal when moving the virtual microphone away from the positions of the sensor arrays. In fact, as discussed above, in diffuse sound fields, we expect that most IPLS are localized near the two sensor arrays. Thus, when moving the virtual microphone away from these positions, we likely increase the distance $s=\|s\|$ in FIG. 6. Therefore, the magnitude of the reference pressure is decreased when applying a weighting according to formula (11). Correspondingly, when moving the virtual microphone close to an actual sound source, the time-frequency bins corresponding to the direct sound will be amplified such that the overall audio signal will be perceived less diffuse. By adjusting the rule in formula (12), one can control the direct sound amplification and diffuse sound suppression at will.

By conducting propagation compensation on the recorded audio input signal (e.g. the pressure signal) of the first real spatial microphone, a first modified audio signal is obtained.

In embodiments, a second modified audio signal may be obtained by conducting propagation compensation on a recorded second audio input signal (second pressure signal) of the second real spatial microphone.

In other embodiments, further audio signals may be obtained by conducting propagation compensation on recorded further audio input signals (further pressure signals) of further real spatial microphones.

Now, combining in blocks 502 and 505 in FIG. 8 according to an embodiment is explained in more detail. It is assumed that two or more audio signals from a plurality different real spatial microphones have been modified to compensate for the different propagation paths to obtain two or more modified audio signals. Once the audio signals from the different real spatial microphones have been modified to compensate for the different propagation paths, they can be combined to improve the audio quality. By doing so, for example, the SNR can be increased or the reverberance can be reduced.

Possible solutions for the combination comprise:

- Weighted averaging, e.g., considering SNR, or the distance to the virtual microphone, or the diffuseness which was estimated by the real spatial microphones. Traditional solutions, for example, Maximum Ratio Combining (MRC) or Equal Gain Combining (EQC) may be employed, or
- Linear combination of some or all of the modified audio signals to obtain a combination signal. The modified audio signals may be weighted in the linear combination to obtain the combination signal, or
- Selection, e.g., only one signal is used, for example, dependent on SNR or distance or diffuseness.

The task of module 502 is, if applicable, to compute parameters for the combining, which is carried out in module 505.

Now, spectral weighting according to embodiments is described in more detail. For this, reference is made to blocks 503 and 506 of FIG. 8. At this final step, the audio signal resulting from the combination or from the propagation compensation of the input audio signals is weighted in the time-frequency domain according to spatial characteristics of the virtual spatial microphone as specified by input 104 and/or according to the reconstructed geometry (given in 205).

Figure 10:
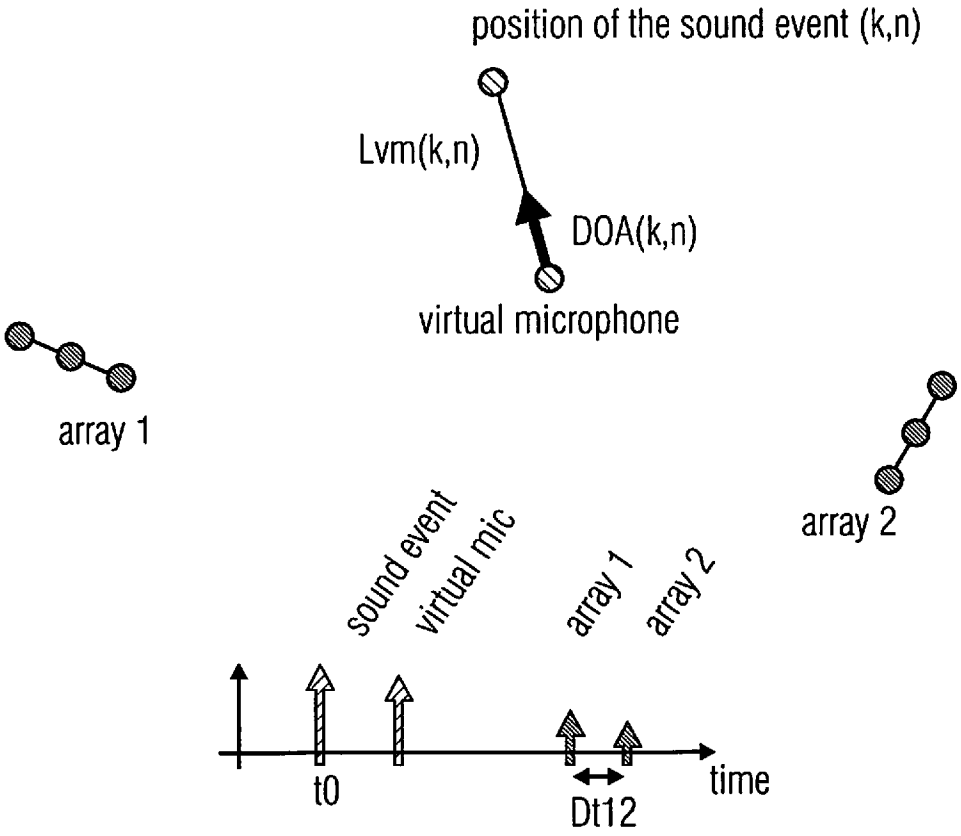
FIG. 10 illustrates, how to obtain the direction of arrival relative to a virtual microphone according to an embodiment.

For each time-frequency bin the geometrical reconstruction allows us to easily obtain the DOA relative to the virtual microphone, as shown in FIG. 10. Furthermore, the distance between the virtual microphone and the position of the sound event can also be readily computed.

The weight for the time-frequency bin is then computed considering the type of virtual microphone desired.

In case of directional microphones, the spectral weights may be computed according to a predefined pick-up pattern. For example, according to an embodiment, a cardioid microphone may have a pick up pattern defined by the function g(theta), $$g(\text{theta})=0.5+0.5\cos(\text{theta}),$$

where theta is the angle between the look direction of the virtual spatial microphone and the DOA of the sound from the point of view of the virtual microphone.

Another possibility is artistic (non physical) decay functions. In certain applications, it may be desired to suppress sound events far away from the virtual microphone with a factor greater than the one characterizing free-field propagation. For this purpose, some embodiments introduce an additional weighting function which depends on the distance between the virtual microphone and the sound event. In an embodiment, only sound events within a certain distance (e.g. in meters) from the virtual microphone should be picked up.

With respect to virtual microphone directivity, arbitrary directivity patterns can be applied for the virtual microphone. In doing so, one can for instance separate a source from a complex sound scene.

Since the DOA of the sound can be computed in the position $p_v$ of the virtual microphone, namely $$\varphi_v(k, n) = \arccos\left(\frac{s \cdot c_v}{\|s\|}\right), \tag{13}$$

where $c_v$ is a unit vector describing the orientation of the virtual microphone, arbitrary directivities for the virtual microphone can be realized. For example, assuming that $P_v(k, n)$ indicates the combination signal or the propagation-compensated modified audio signal, then the formula:

$$\tilde{P}_v(k,n)=P_v(k,n)[1+\cos(\phi_v(k,n))] \tag{14}$$

calculates the output of a virtual microphone with cardioid directivity. The directional patterns, which can potentially be generated in this way, depend on the accuracy of the position estimation.

In embodiments, one or more real, non-spatial microphones, for example, an omnidirectional microphone or a directional microphone such as a cardioid, are placed in the sound scene in addition to the real spatial microphones to further improve the sound quality of the virtual microphone signals 105 in FIG. 8. These microphones are not used to gather any geometrical information, but rather only to provide a cleaner audio signal. These microphones may be placed closer to the sound sources than the spatial microphones. In this case, according to an embodiment, the audio signals of the real, non-spatial microphones and their positions are simply fed to the propagation compensation module 504 of FIG. 8 for processing, instead of the audio signals of the real spatial microphones. Propagation compensation is then conducted for the one or more recorded audio signals of the non-spatial microphones with respect to the position of the one or more non-spatial microphones. By this, an embodiment is realized using additional non-spatial microphones.

In a further embodiment, computation of the spatial side information of the virtual microphone is realized. To compute the spatial side information 106 of the microphone, the information computation module 202 of FIG. 8 comprises a spatial side information computation module 507, which is adapted to receive as input the sound sources' positions 205 and the position, orientation and characteristics 104 of the virtual microphone. In certain embodiments, according to the side information 106 that needs to be computed, the audio signal of the virtual microphone 105 can also be taken into account as input to the spatial side information computation module 507.

The output of the spatial side information computation module 507 is the side information of the virtual microphone 106. This side information can be, for instance, the DOA or the diffuseness of sound for each time-frequency bin (k, n) from the point of view of the virtual microphone. Another possible side information could, for instance, be the active sound intensity vector Ia(k, n) which would have been measured in the position of the virtual microphone. How these parameters can be derived, will now be described.

According to an embodiment, DOA estimation for the virtual spatial microphone is realized. The information computation module 120 is adapted to estimate the direction of arrival at the virtual microphone as spatial side information, based on a position vector of the virtual microphone and based on a position vector of the sound event as illustrated by FIG. 11.

Figure 11:
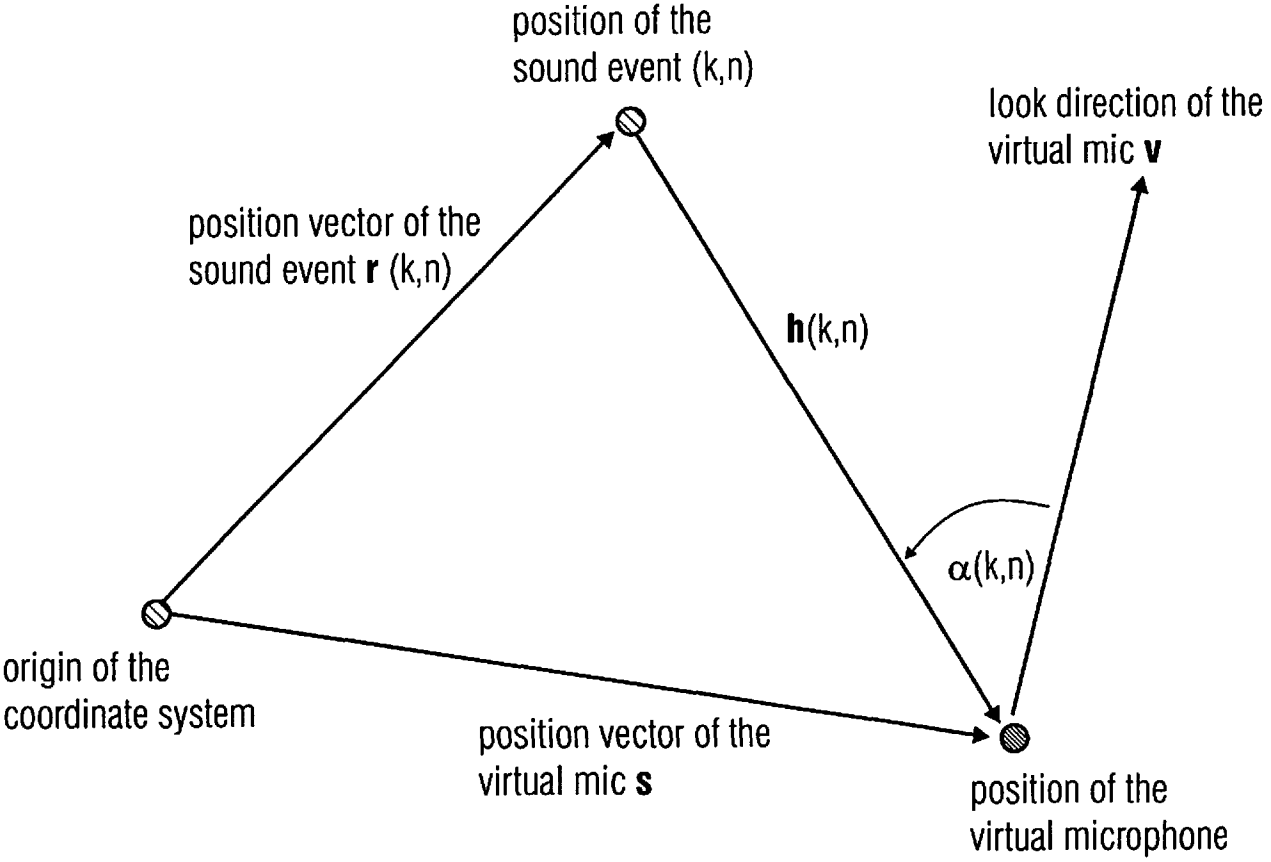
FIG. 11 depicts a possible way to derive the DOA of the sound from the point of view of the virtual microphone according to an embodiment.

FIG. 11 depicts a possible way to derive the DOA of the sound from the point of view of the virtual microphone. The position of the sound event, provided by block 205 in FIG. 8, can be described for each time-frequency bin (k, n) with a position vector r(k, n), the position vector of the sound event. Similarly, the position of the virtual microphone, provided as input 104 in FIG. 8, can be described with a position vector s(k,n), the position vector of the virtual microphone. The look direction of the virtual microphone can be described by a vector v(k, n). The DOA relative to the virtual microphone is given by a(k,n). It represents the angle between v and the sound propagation path h(k,n). h(k, n) can be computed by employing the formula:

$$h(k,n)=s(k,n)-r(k,n).$$

The desired DOA a(k, n) can now be computed for each (k, n) for instance via the definition of the dot product of h(k, n) and v(k,n), namely $$a(k,n)=\arccos(h(k,n)\cdot v(k,n)/(\|h(k,n)\|\|v(k,n)\|).$$

In another embodiment, the information computation module 120 may be adapted to estimate the active sound intensity at the virtual microphone as spatial side information, based on a position vector of the virtual microphone and based on a position vector of the sound event as illustrated by FIG. 11.

From the DOA a(k, n) defined above, we can derive the active sound intensity Ia(k, n) at the position of the virtual microphone. For this, it is assumed that the virtual microphone audio signal 105 in FIG. 8 corresponds to the output of an omnidirectional microphone, e.g., we assume, that the virtual microphone is an omnidirectional microphone. Moreover, the looking direction v in FIG. 11 is assumed to be parallel to the x-axis of the coordinate system. Since the desired active sound intensity vector Ia(k, n) describes the net flow of energy through the position of the virtual microphone, we can compute Ia(k, n) can be computed, e.g. according to the formula:

$$Ia(k,n)=-(\tfrac{1}{2}\mathrm{rho})|P_v(k,n)|^2*[\cos a(k,n), \sin a(k,n)]^T,$$

where $[\ ]^T$ denotes a transposed vector, rho is the air density, and $P_v(k, n)$ is the sound pressure measured by the virtual spatial microphone, e.g., the output 105 of block 506 in FIG. 8.

If the active intensity vector shall be computed expressed in the general coordinate system but still at the position of the virtual microphone, the following formula may be applied:

$$Ia(k,n)=(\tfrac{1}{2}\mathrm{rho})|P_v(k,n)|^2 h(k,n)/\|h(k,n)\|.$$

The diffuseness of sound expresses how diffuse the sound field is in a given time-frequency slot (see, for example, [2]). Diffuseness is expressed by a value ψ, wherein $0\leq\psi\leq1$. A diffuseness of 1 indicates that the total sound field energy of a sound field is completely diffuse. This information is important e.g. in the reproduction of spatial sound. Traditionally, diffuseness is computed at the specific point in space in which a microphone array is placed.

According to an embodiment, the diffuseness may be computed as an additional parameter to the side information generated for the Virtual Microphone (VM), which can be placed at will at an arbitrary position in the sound scene. By this, an apparatus that also calculates the diffuseness besides the audio signal at a virtual position of a virtual microphone can be seen as a virtual DirAC front-end, as it is possible to produce a DirAC stream, namely an audio signal, direction of arrival, and diffuseness, for an arbitrary point in the sound scene. The DirAC stream may be further processed, stored, transmitted, and played back on an arbitrary multi-loudspeaker setup. In this case, the listener experiences the sound scene as if he or she were in the position specified by the virtual microphone and were looking in the direction determined by its orientation.

Figure 12:
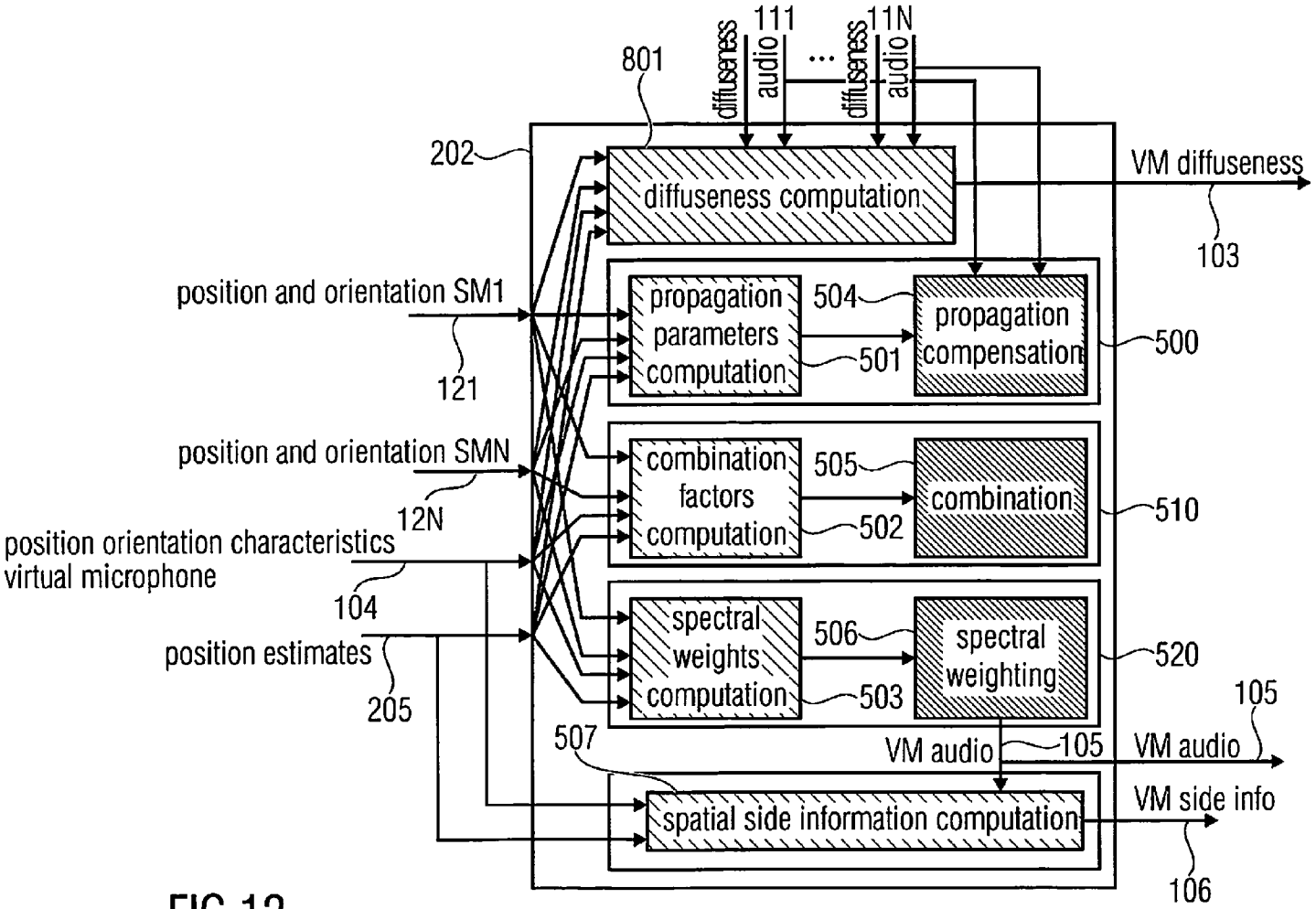
FIG. 12 illustrates an information computation block additionally comprising a diffuseness computation unit according to an embodiment.

FIG. 12 illustrates an information computation block according to an embodiment comprising a diffuseness computation unit 801 for computing the diffuseness at the virtual microphone. The information computation block 202 is adapted to receive inputs 111 to 11N, that in addition to the inputs of FIG. 3 also include diffuseness at the real spatial microphones. Let $\psi^{(SM1)}$ to $\psi^{(SMN)}$ denote these values. These additional inputs are fed to the information computation module 202. The output 103 of the diffuseness computation unit 801 is the diffuseness parameter computed at the position of the virtual microphone.

Figure 13:
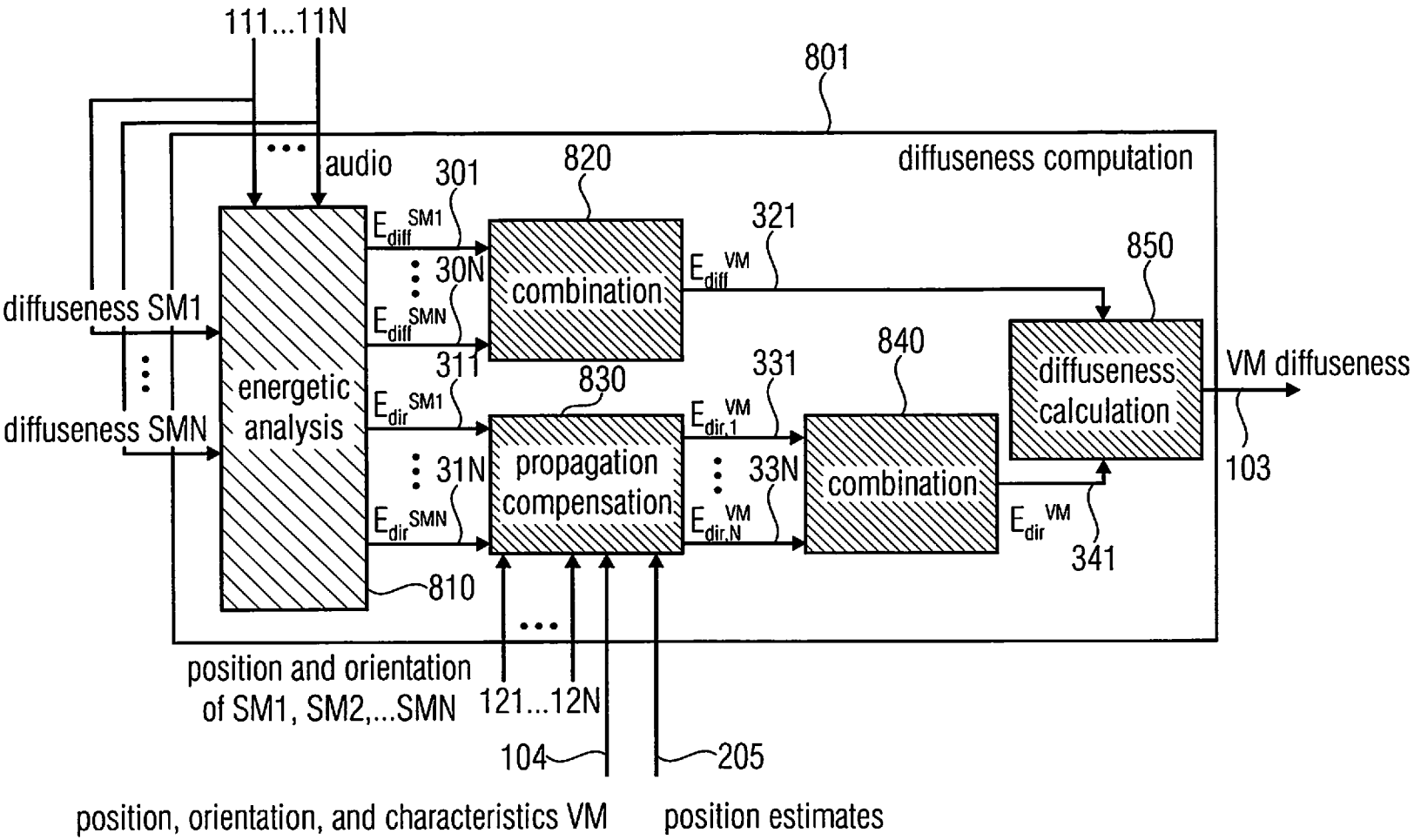
FIG. 13 depicts a diffuseness computation unit according to an embodiment.

A diffuseness computation unit 801 of an embodiment is illustrated in FIG. 13 depicting more details. According to an embodiment, the energy of direct and diffuse sound at each of the N spatial microphones is estimated. Then, using the information on the positions of the IPLS, and the information on the positions of the spatial and virtual microphones, N estimates of these energies at the position of the virtual microphone are obtained. Finally, the estimates can be combined to improve the estimation accuracy and the diffuseness parameter at the virtual microphone can be readily computed.

Let $E_{dir}^{(SM1)}$ to $E_{dir}^{(SMN)}$ and $E_{diff}^{(SM1)}$ to $E_{diff}^{(SMN)}$ denote the estimates of the energies of direct and diffuse sound for the N spatial microphones computed by energy analysis unit 810. If $P_i$ is the complex pressure signal and $\psi_i$ is diffuseness for the i-th spatial microphone, then the energies may, for example, be computed according to the formulae:

$$E_{dir}^{(SMi)}=(1-\Psi_i)\cdot|P_i|^2$$

$$E_{diff}^{(SMi)}=\Psi_i\cdot|P_i|^2$$

The energy of diffuse sound should be equal in all positions, therefore, an estimate of the diffuse sound energy $E_{diff}^{(VM)}$ at the virtual microphone can be computed simply by averaging $E_{diff}^{(SM1)}$ to $E_{diff}^{(SMN)}$, e.g. in a diffuseness combination unit 820, for example, according to the formula:

$$E_{diff}^{(VM)}=\frac{1}{N}\sum_{i=1}^{N}E_{diff}^{(SMi)}$$

A more effective combination of the estimates $E_{diff}^{(SM1)}$ to $E_{diff}^{(SMN)}$ could be carried out by considering the variance of the estimators, for instance, by considering the SNR.

The energy of the direct sound depends on the distance to the source due to the propagation. Therefore, $E_{dir}^{(SM1)}$ to $E_{dir}^{(SMN)}$ may be modified to take this into account. This may be carried out, e.g., by a direct sound propagation adjustment unit 830. For example, if it is assumed that the energy of the direct sound field decays with 1 over the distance squared, then the estimate for the direct sound at the virtual microphone for the i-th spatial microphone may be calculated according to the formula:

$$E_{dir,i}^{(VM)} = \left(\frac{\text{distance } SMi - IPLS}{\text{distance } VM - IPLS}\right)^2 E_{dir}^{(SMi)}$$

Similarly to the diffuseness combination unit 820, the estimates of the direct sound energy obtained at different spatial microphones can be combined, e.g. by a direct sound combination unit 840. The result is $E_{dir}^{(VM)}$, e.g., the estimate for the direct sound energy at the virtual microphone. The diffuseness at the virtual microphone $\psi^{(VM)}$ may be computed, for example, by a diffuseness sub-calculator 850, e.g. according to the formula:

$$\Psi^{(VM)} = \frac{E_{diff}^{(VM)}}{E_{diff}^{(VM)} + E_{dir}^{(VM)}}$$

Figure 14:
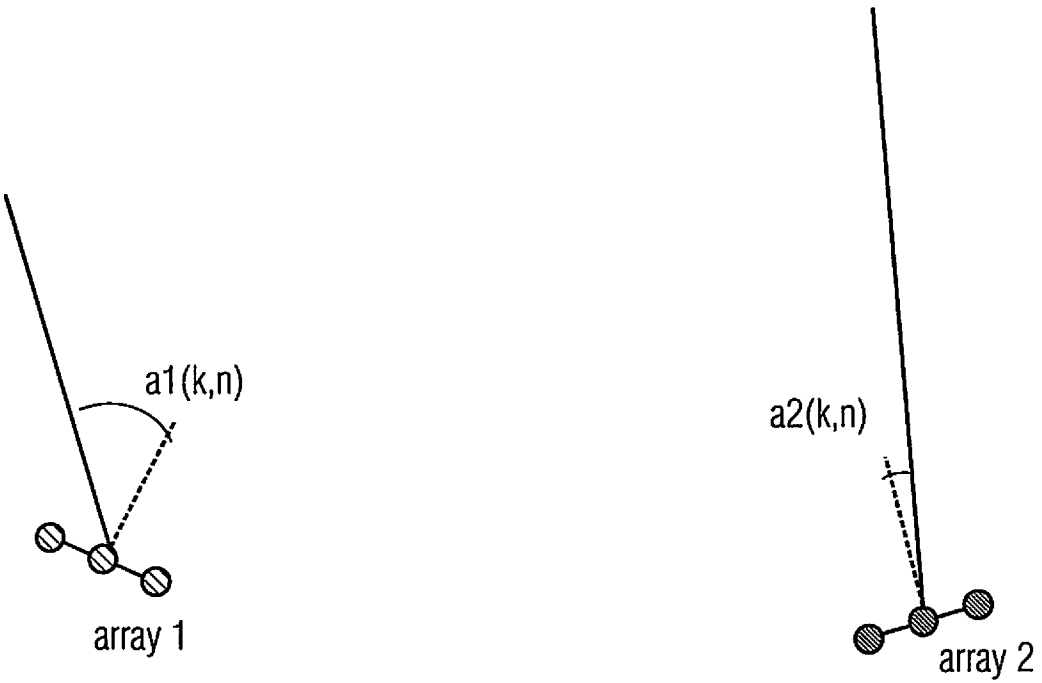
FIG. 14 illustrates a scenario, where the sound events position estimation is not possible.

As mentioned above, in some cases, the sound events position estimation carried out by a sound events position estimator fails, e.g., in case of a wrong direction of arrival estimation. FIG. 14 illustrates such a scenario. In these cases, regardless of the diffuseness parameters estimated at the different spatial microphone and as received as inputs 111 to 11N, the diffuseness for the virtual microphone 103 may be set to 1 (i.e., fully diffuse), as no spatially coherent reproduction is possible.

Additionally, the reliability of the DOA estimates at the N spatial microphones may be considered. This may be expressed e.g. in terms of the variance of the DOA estimator or SNR. Such an information may be taken into account by the diffuseness sub-calculator 850, so that the VM diffuseness 103 can be artificially increased in case that the DOA estimates are unreliable. In fact, as a consequence, the position estimates 205 will also be unreliable.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus.

The inventive decomposed signal can be stored on a digital storage medium or can be transmitted on a transmission medium such as a wireless transmission medium or a wired transmission medium such as the Internet.

Depending on certain implementation requirements, embodiments of the invention can be implemented in hardware or in software. The implementation can be performed using a digital storage medium, for example a floppy disk, a DVD, a CD, a ROM, a PROM, an EPROM, an EEPROM or a FLASH memory, having electronically readable control signals stored thereon, which cooperate (or are capable of cooperating) with a programmable computer system such that the respective method is performed.

Some embodiments according to the invention comprise a non-transitory data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods are advantageously performed by any hardware apparatus.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

Literature

[1] R. K. Furness, "Ambisonics—An overview," in AES 8$^{th}$ International Conference, April 1990, pp. 181-189.

[2] V. Pulkki, "Directional audio coding in spatial sound reproduction and stereo upmixing," in Proceedings of the AES 28$^{th}$ International Conference, pp. 251-258, Piteå, Sweden, June 30-Jul. 2, 2006.

[3] V. Pulkki, "Spatial sound reproduction with directional audio coding," J. Audio Eng. Soc., vol. 55. no. 6, pp. 503-516, June 2007.

[4] C. Faller: "Microphone Front-Ends for Spatial Audio Coders", in Proceedings of the AES 125$^{th}$ International Convention, San Francisco, October 2008.

[5] M. Kallinger, H. Ochsenfeld, G. Del Galdo, Küch, D. Mahne, R. Schultz-Amling. and O. Thiergart, "A spatial filtering approach for directional audio coding," in Audio Engineering Society Convention 126, Munich, Germany, May 2009.

[6] R. Schultz-Amling, F. Küch. O. Thiergart, and M. Kallinger, "Acoustical zooming based on a parametric sound field representation," in Audio Engineering Society Convention 128, London UK, May 2010.

[7] J. Herre, C. Falch, D. Mahne, G. Del Galdo, M. Kallinger, and O. Thiergart, "Interactive teleconferencing combining spatial audio object coding and DirAC technology," in Audio Engineering Society Convention 128, London UK, May 2010.

[8] E. G. Williams, Fourier Acoustics: Sound Radiation and Nearfield Acoustical Holography, Academic Press. 1999.

[9] A. Kuntz and R. Rabenstein, "Limitations in the extrapolation of wave fields from circular measurements," in 15th European Signal Processing Conference (EUSIPCO 2007), 2007.

[10] A. Walther and C. Faller, "Linear simulation of spaced microphone arrays using b-format recordings," in Audio Engineering Society Convention 128, London UK, May 2010.

[11] US61/287,596: An Apparatus and a Method for Converting a First Parametric Spatial Audio Signal into a Second Parametric Spatial Audio Signal.

[12] S. Rickard and Z. Yilmaz, "On the approximate W-disjoint orthogonality of speech," in Acoustics, Speech and Signal Processing, 2002. ICASSP 2002. IEEE International Conference on, April 2002, vol. 1.

[13] R. Roy, A. Paulraj, and T. Kailath, "Direction-of-arrival estimation by subspace rotation methods—ESPRIT," in IEEE International Conference on Acoustics, Speech, and Signal Processing (ICASSP), Stanford, Calif., USA, April 1986.

[14] R. Schmidt, "Multiple emitter location and signal parameter estimation," IEEE Transactions on Antennas and Propagation, vol. 34, no. 3, pp. 276-280, 1986.

[15] J. Michael Steele, "Optimal Triangulation of Random Samples in the Plane", The Annals of Probability, Vol. 10, No. 3 (August, 1982), pp. 548-553.

[16] F. J. Fahy, Sound Intensity, Essex: Elsevier Science Publishers Ltd., 1989.

[17] R. Schultz-Amling, F. Each, M. Kallinger, G. Del Galdo, T. Ahonen and V. Pulkki, "Planar microphone array processing for the analysis and reproduction of spatial audio using directional audio coding," in Audio Engineering Society Convention 124, Amsterdam. The Netherlands, May 2008.

[18] M. Kallinger, F. Küch, R. Schultz-Amling, G. Del Galdo, T. Ahonen and V. Pulkki, "Enhanced direction estimation using microphone arrays for directional audio coding;" in Hands-Free Speech Communication and Microphone Arrays, 2008. HSCMA 2008, May 2008, pp. 45-48.

The invention claimed is:

1. An apparatus for generating an audio output signal to simulate a recording of the audio output signal by a virtual microphone at a configurable virtual position in an environment, comprising:

a sound events position estimator for estimating a sound event position indicating a position of a sound event in the environment, wherein the sound event is active at a certain time instant or in a certain time-frequency bin, wherein the sound event is a real sound source or a mirror image source, wherein the sound events position estimator is configured to estimate the sound event position indicating a position of a mirror image source in the environment when the sound event is a mirror image source, and wherein the sound events position estimator is adapted to estimate the sound event position based on a first direction information provided by a first real spatial microphone being located at a first real microphone position in the environment, and based on a second direction information provided by a second real spatial microphone being located at a second real microphone position in the environment, wherein the first real spatial microphone and the second real spatial microphone are spatial microphones which physically exist; and wherein the first real spatial microphone and the second real spatial microphone are apparatuses for acquisition of spatial sound capable of retrieving direction of arrival of sound, and an information computation module for generating the audio output signal based on a first recorded audio input signal, based on the first real microphone position, based on the virtual position of the virtual microphone, and based on the sound event position, wherein the first real spatial microphone is configured to record the first recorded audio input signal, or wherein a third microphone is configured to record the first recorded audio input signal, wherein the sound events position estimator is adapted to estimate the sound event position based on a first direction of arrival of the sound wave emitted by the sound event at the first real microphone position as the first direction information and based on a second direction of arrival of the sound wave at the second real microphone position as the second direction information, and wherein the information computation module comprises a propagation compensator, wherein the propagation compensator is adapted to generate a first modified audio signal by modifying the first recorded audio input signal, based on a first amplitude decay between the sound event and the first real spatial microphone and based on a second amplitude decay between the sound event and the virtual microphone, by adjusting an amplitude value, a magnitude value or a phase value of the first recorded audio input signal, to acquire the audio output signal; or wherein the propagation compensator is adapted to generate a first modified audio signal by compensating a first time delay between an arrival of a sound wave emitted by the sound event at the first real spatial microphone and an arrival of the sound wave at the virtual microphone by adjusting an amplitude value, a magnitude value or a phase value of the first recorded audio input signal, to acquire the audio output signal.

2. An apparatus according to claim 1, wherein the information computation module comprises a spatial side information computation module for computing spatial side information, wherein the information computation module is adapted to estimate the direction of arrival or an active sound intensity at the virtual microphone as spatial side information, based on a position vector of the virtual microphone and based on a position vector of the sound event.

3. An apparatus according to claim 1, wherein the propagation compensator is adapted to generate the first modified audio signal in a time-frequency domain, based on the first amplitude decay between the sound event and the first real spatial microphone and based on the second amplitude decay between the sound event and the virtual microphone, by adjusting said magnitude value of the first recorded audio input signal being represented in a time-frequency domain.

4. An apparatus according to claim 1, wherein the propagation compensator is adapted to generate the first modified audio signal in the time-frequency domain, by compensating the first time delay between the arrival of the sound wave emitted by the sound event at the first real spatial microphone and the arrival of the sound wave at the virtual microphone by adjusting said magnitude value of the first recorded audio input signal being represented in a time-frequency domain.

5. An apparatus according to claim 1, wherein the propagation compensator is adapted to conduct propagation compensation by generating a modified magnitude value of the first modified audio signal by applying the formula:

$$P_v(k, n) = \frac{d_1(k, n)}{s(k, n)} P_{ref}(k, n)$$

wherein $d_1(k, n)$ is the distance between the position of the first real spatial microphone and the position of the sound event, wherein s(k, n) is the distance between the virtual position of the virtual microphone and the sound event position of the sound event, wherein $P_{ref}(k, n)$ is a magnitude value of the first recorded audio input signal being represented in a time-frequency domain, and wherein $P_v(k, n)$ is the modified magnitude value corresponding to the signal of the virtual microphone, wherein k denotes a frequency index and wherein n denotes a time index.

6. An apparatus according to claim 1, wherein the information computation module further comprises a combiner, wherein the propagation compensator is furthermore adapted to modify a second recorded audio input signal, being recorded by the second real spatial microphone, by compensating a second time delay or a second amplitude decay between an arrival of the sound wave emitted by the sound event at the second real spatial microphone and an arrival of the sound wave at the virtual microphone, by adjusting an amplitude value, a magnitude value or a phase value of the second recorded audio input signal to acquire a second modified audio signal, and wherein the combiner is adapted to generate a combination signal by combining the first modified audio signal and the second modified audio signal, to acquire the audio output signal.

7. An apparatus according to claim 6, wherein the propagation compensator is furthermore adapted to modify one or more further recorded audio input signals, being recorded by one or more further real spatial microphones, by compensating time delays or amplitude decays between an arrival of the sound wave at the virtual microphone and an arrival of the sound wave emitted by the sound event at each one of the further real spatial microphones, wherein the propagation compensator is adapted to compensate each of the time delays or amplitude decays by adjusting an amplitude value, a magnitude value or a phase value of each one of the further recorded audio input signals to acquire a plurality of third modified audio signals, and wherein the combiner is adapted to generate a combination signal by combining the first modified audio signal and the second modified audio signal and the plurality of third modified audio signals, to acquire the audio output signal.

8. An apparatus according to claim 1, wherein the information computation module comprises a spectral weighting unit for generating a weighted audio signal by modifying the first modified audio signal depending on a direction of arrival of the sound wave at the virtual position of the virtual microphone and depending on a unit vector describing the orientation of the virtual microphone, to acquire the audio output signal, wherein the first modified audio signal is modified in a time-frequency domain.

9. An apparatus according to claim 6, wherein the information computation module comprises a spectral weighting unit for generating a weighted audio signal by modifying the combination signal depending on a direction of arrival or the sound wave at the virtual position of the virtual microphone and depending on a unit vector describing the orientation of the virtual microphone to acquire the audio output signal, wherein the combination signal is modified in a time-frequency domain.

10. An apparatus according to claim 8, wherein the spectral weighting unit is adapted to apply the weighting factor $\alpha+(1-\alpha)\cos(\phi_v(k, n))$, or the weighting factor $0.5+0.5\cos(\phi_v(k, n))$ on the weighted audio signal, wherein $\phi_v(k, n)$ indicates an angle specifying a direction of arrival of the sound wave emitted by the sound event at the virtual position of the virtual microphone, wherein k denotes a frequency index and wherein n denotes a time index.

11. An apparatus according to claim 1, wherein the propagation compensator is furthermore adapted to generate a third modified audio signal by modifying a third recorded audio input signal recorded by a fourth microphone by compensating a third time delay or a third amplitude decay between an arrival of the sound wave emitted by the sound event at the fourth microphone and an arrival of the sound wave at the virtual microphone by adjusting an amplitude value, a magnitude value or a phase value of the third recorded audio input signal, to acquire the audio output signal.

12. An apparatus according to claim 1, wherein the sound events position estimator is adapted to estimate a sound event position in a three-dimensional environment.

13. An apparatus according to claim 1, wherein the information computation module further comprises a diffuseness computation unit being adapted to estimate a diffuse sound energy at the virtual microphone or a direct sound energy at the virtual microphone, wherein the diffuseness computation unit is adapted to estimate the diffuse sound energy at the virtual microphone based on diffuse sound energies at the first and the second real spatial microphone.

14. An apparatus according to claim 13, wherein the diffuseness computation unit is adapted to estimate the diffuse sound energy $E_{diff}^{(VM)}$ at the virtual microphone by applying the formula:

$$E_{diff}^{(VM)} = \frac{1}{N} \sum_{i=1}^{N} E_{diff}^{(SMi)}$$

wherein N is the number of a plurality of real spatial microphones comprising the first and the second real spatial microphone, and wherein $E_{diff}^{(SMi)}$ is the diffuse sound energy at the i-th real spatial microphone.

15. An apparatus according to claim 13, wherein the diffuseness computation unit is adapted to estimate the direct sound energy by applying the formula:

$$E_{dir,i}^{(VM)} = \left(\frac{\text{distance } SMi - IPLS}{\text{distance } VM - IPLS}\right)^2 E_{dir}^{(SMi)}$$

wherein "distance SMi-IPLS" is the distance between a position of the i-th real spatial microphone and the sound event position, wherein "distance VM-IPLS" is the distance between the virtual position and the sound event position, and wherein $E_{dir}^{(SMi)}$ is the direct energy at the i-th real spatial microphone.

16. An apparatus according to claim 13, wherein the diffuseness computation unit is adapted to estimate the diffuseness at the virtual microphone by estimating the diffuse sound energy at the virtual microphone and the direct sound energy at the virtual microphone and by applying the formula:

$$\psi^{(VM)} = \frac{E_{diff}^{(VM)}}{E_{diff}^{(VM)} + E_{dir}^{(VM)}}$$

wherein $\psi^{(VM)}$ indicates the diffuseness at the virtual microphone being estimated, wherein $E_{diff}^{(VM)}$ indicates the diffuse sound energy being estimated and wherein $E_{dir}^{(VM)}$ indicates the direct sound energy being estimated.

17. A method for generating an audio output signal to simulate a recording of the audio output signal by a virtual microphone at a configurable virtual position in an environment, comprising:

estimating a sound event position indicating a position of a sound event in the environment, wherein the sound event is active at a certain time instant or in a certain time-frequency bin, wherein the sound event is a real sound source or a mirror image source, wherein estimating the sound event position comprises estimating the sound event position indicating a position of a mirror image source in the environment when the sound event is a mirror image source, and wherein estimating the sound event position is based on a first direction information provided by a first real spatial microphone being located at a first real microphone position in the environment, and based on a second direction information provided by a second real spatial microphone being located at a second real microphone position in the environment, wherein the first real spatial microphone and the second real spatial microphone are spatial microphones which physically exist; and wherein the first real spatial microphone and the second real spatial microphone are apparatuses for acquisition of spatial sound capable of retrieving direction of arrival of sound, and generating the audio output signal based on a first recorded audio input signal, based on the first real microphone position, based on the virtual position of the virtual microphone, and based on the sound event position, wherein the first real spatial microphone is configured to record the first recorded audio input signal, or wherein a third microphone is configured to record the first recorded audio input signal, wherein estimating the sound event position is conducted based on a first direction of arrival of the sound wave emitted by the sound event at the first real microphone position as the first direction information and based on a second direction of arrival of the sound wave at the second real microphone position as the second direction information, wherein generating the audio output signal comprises generating a first modified audio signal by modifying the first recorded audio input signal, based on a first amplitude decay between the sound event and the first real spatial microphone and based on a second amplitude decay between the sound event and the virtual microphone, by adjusting an amplitude value, a magnitude value or a phase value of the first recorded audio input signal, to acquire the audio output signal; or wherein generating the audio output signal comprises generating a first modified audio signal by compensating a first time delay between an arrival of a sound wave emitted by the sound event at the first real spatial microphone and an arrival of the sound wave at the virtual microphone by adjusting an amplitude value, a magnitude value or a phase value of the first recorded audio input signal, to acquire the audio output signal.

18. A non-transitory computer-readable medium comprising a computer program for implementing the method for generating an audio output signal to simulate a recording of the audio output signal by a virtual microphone at a configurable virtual position in an environment, said method comprising:

estimating a sound event position indicating a position of a sound event in the environment, wherein the sound event is active at a certain time instant or in a certain time-frequency bin, wherein the sound event is a real sound source or a mirror image source, wherein estimating the sound event position comprises estimating the sound event position indicating a position of a mirror image source in the environment when the sound event is a mirror image source, and wherein estimating the sound event position is based on a first direction information provided by a first real spatial microphone being located at a first real microphone position in the environment, and based on a second direction information provided by a second real spatial microphone being located at a second real microphone position in the environment, wherein the first real spatial microphone and the second real spatial microphone are spatial microphones which physically exist; and wherein the first real spatial microphone and the second real spatial microphone are apparatuses for acquisition of spatial sound capable of retrieving direction of arrival of sound, and generating the audio output signal based on a first recorded audio input signal, based on the first real microphone position, based on the virtual position of the virtual microphone, and based on the sound event position, wherein the first real spatial microphone is configured to record the first recorded audio input signal, or wherein a third microphone is configured to record the first recorded audio input signal, wherein estimating the sound event position is conducted based on a first direction of arrival of the sound wave emitted by the sound event at the first real microphone position as the first direction information and based on a second direction of arrival of the sound wave at the second real microphone position as the second direction information, wherein generating the audio output signal comprises generating a first modified audio signal by modifying the first recorded audio input signal, based on a first amplitude decay between the sound event and the first real spatial microphone and based on a second amplitude decay between the sound event and the virtual microphone, by adjusting an amplitude value, a magnitude value or a phase value of the first recorded audio input signal, to acquire the audio output signal; or wherein generating the audio output signal comprises generating a first modified audio signal by compensating a first time delay between an arrival of a sound wave emitted by the sound event at the first real spatial microphone and an arrival of the sound wave at the virtual microphone by adjusting an amplitude value, a magnitude value or a phase value of the first recorded audio input signal, to acquire the audio output signal, when being executed on a computer or a signal processor.

* * * * *